United States Patent [19]

Sasaki et al.

[11] Patent Number: 4,787,616

[45] Date of Patent: Nov. 29, 1988

[54] SHEET STACKING DEVICE AND IMAGE FORMING APPARATUS PROVIDED WITH SAME

[75] Inventors: Nobukazu Sasaki, Tokyo; Toshirou Kasamura, Yokohama; Atsushi Kubota, Machida; Yasuyoshi Yamamoto; Masashi Ohashi, both of Tokyo; Michiro Koike, Kawasaki; Tatsuya Shiratori, Yokohama; Akiyoshi Kimura, Tokyo; Takashi Ozawa, Ichikawa, all of Japan

[73] Assignee: Canon Kabushiki Kaisha, Tokyo, Japan

[21] Appl. No.: 791,404

[22] Filed: Oct. 25, 1985

[30] Foreign Application Priority Data

| | | | |
|---|---|---|---|
| Oct. 26, 1984 | [JP] | Japan | 59-226283 |
| Oct. 26, 1984 | [JP] | Japan | 59-226284 |
| Nov. 30, 1984 | [JP] | Japan | 59-254375 |
| Nov. 30, 1984 | [JP] | Japan | 59-254376 |
| Dec. 18, 1984 | [JP] | Japan | 59-267094 |
| Dec. 18, 1984 | [JP] | Japan | 59-267095 |
| Dec. 18, 1984 | [JP] | Japan | 59-267096 |
| Dec. 18, 1984 | [JP] | Japan | 59-267097 |
| Dec. 20, 1984 | [JP] | Japan | 59-269197 |

[51] Int. Cl.[4] ..... B65H 3/00

[52] U.S. Cl. ..... 271/3.1; 271/176; 271/184; 271/186; 271/289; 271/291; 271/294; 271/298; 271/303

[58] Field of Search ..... 271/288, 3.1, 293, 294, 271/298, 296, 65, 291, 301, 305, 279, 287, 292, 297, 184–186, 303, 902, 176, 289; 270/58; 355/4.3 SH, 14 SH, 23, 24

[56] References Cited

U.S. PATENT DOCUMENTS

| | | | |
|---|---|---|---|
| 3,960,445 | 6/1976 | Drawe | 355/4 |
| 3,995,748 | 12/1976 | Looney | 270/58 |
| 4,145,037 | 3/1979 | Mol | 270/58 |
| 4,145,038 | 3/1979 | Mol | 270/58 |
| 4,146,215 | 3/1979 | Mol | 270/58 |
| 4,184,671 | 1/1980 | Sasamori | 271/18 |
| 4,200,386 | 4/1980 | Queener | 271/4 |
| 4,379,549 | 4/1983 | Mizuma | 271/3.1 |
| 4,385,825 | 5/1983 | Kaneko | 355/3 SH |
| 4,471,954 | 9/1984 | Bourg | 270/58 |
| 4,534,643 | 8/1985 | Watanabe | 355/3 SH |
| 4,570,918 | 2/1986 | Eisler | 271/3.1 |

FOREIGN PATENT DOCUMENTS

| | | | |
|---|---|---|---|
| 3615958 | 11/1986 | Fed. Rep. of Germany | 271/3.1 |
| 3616509 | 11/1986 | Fed. Rep. of Germany | 271/287 |
| 0123842 | 9/1980 | Japan | 271/3.1 |
| 0052353 | 5/1981 | Japan | 271/3.1 |

OTHER PUBLICATIONS

IBM Technical Disclosure Bulletin, vol. 22, No. 4, Sep. 1979, "Automatic Duplex Copier", Bishop et al., pp. 1379–1387.

*Primary Examiner*—Kevin P. Shaver

*Attorney, Agent, or Firm*—Fitzpatrick, Cella, Harper & Scinto

[57] ABSTRACT

A sheet stacking device and an image forming apparatus provided with the sheet stacking device. The sheet stacking device has a sheet sorting function, and in addition, sheet re-feeding function so as to make it possible to produce a duplex copy or superimposed copy. It is further possible to use the sorter portion as a sheet feeding facility.

14 Claims, 19 Drawing Sheets

SHEET STACKING DEVICE AND IMAGE FORMING APPARATUS PROVIDED WITH SAME

FIELD OF THE INVENTION AND RELATED ART

The present invention relates to a sheet stacking device and an image forming apparatus provided with the sheet stacking device. More particularly, it relates to a sheet stacking device provided with a sorter mechanism for sorting sheet materials such as transfer sheets, which may be used with an image forming apparatus such as a copying machine.

Recently, it has been desired that image forming apparatus such as copying machines (hereinafter reference will be made only to a copying apparatus, although the present invention is applicable to the other types of image forming apparatus) be able systematically to perform multiple functions, such as a sheet sorting function, duplex printing function and superimposed printing function. The multiple function system has been achieved by incorporating the multiple function into the copying or printing apparatus itself or by combining the copying apparatus with a separate sorter or separate duplex copy accessories.

As shown in FIG. 1, an exemplary prior art copying apparatus 1 comprises an original carriage for carrying and reciprocating an original M, a lens system LE fixedly mounted on a supporting member S of a frame of the apparatus and two cassettes $C_1$ and $C_2$ containing a number of sheets of paper, which are detachable from the apparatus. The copying apparatus further comprises a cylindrical photosensitive member 3 rotatable about an axis parallel to the surface of the sheets. Around the photosensitive member 3, a developing device 5, a cleaner 6 and charger 7 are disposed and fixed to a frame 9. The photosensitive member 3, developing device 5, cleaner 6 and charger 7 are constructed as a unit 10 which is detachably mountable into the supporting member S of the main assembly of the copying apparatus. Below the unit 10, there is a feeding device 13 comprising a transfer charger 11, a separation roller 12 and others. Between the feeding device 13 and the cassettes $C_1$ and $C_2$, a pick-up roller 15 and registration rollers 16 are provided. Downstream of the feeding device 13, there is a fixing device 17 which receives the transfer sheet after it has received the image. Adjacent the outlet of the fixing means 17, there is a flapper 19 for changing the direction of the sheet travel. The flapper 19 is effective to selectively direct the sheet to a sorter 20 which is separate equipment from the copying machine 1 or to a conveying belt 23 leading to an intermediate tray 22 within the copying machine. The sorter 20 has a number of sheet receiving bin trays 25, which are movable up and down as a whole by a mechanism 26. The bin trays 25 receive the sheets from the feeding roller 27 and stack them on themselves. The intermediate tray 22 is disposed at a lower part of the copying machine 1 and is inclined to ensure that the sheets are stacked and re-fed. Adjacent the intermediate tray 22, a pick-up roller 29 and feeding rollers 30 are provided.

In operation, when the original carriage 2 moves, the original M carried thereon is illuminated by a light source L, and the light reflected by the original M is projected through a lens system LE onto the photosensitive member 3 surface which has been uniformly charged by the charger 7, so that an electrostatic latent image is formed thereon. The photosensitive member 3 continues to rotate in the direction of an arrow, and the electrostatic latent image is developed by the developing device 5 into a toner image. On the other hand, a sheet contained in the cassettes $C_1$ and $C_2$ is fed therefrom by the pick-up roller 15 and is conveyed by the registration rollers 16 and is brought into contact with the surface of the photosensitive member 3 in alignment with the toner image at the transfer station, where the transfer charger 11 transfers the toner image to the surface of the sheet from the photosensitive member 3. The sheet onto which the toner image has been transferred is separated from the photosensitive member 3 by the separating roller 12 and is advanced to the fixing device 17, where the transferred toner image is fixed. When a simplex copy mode is selected wherein an image is formed only on one side of the copy sheet, the flapper 19 directs the sheet to the sorter side, with the result that the sheet is discharged to a proper one of the trays 25 by the feeding roller 27. The trays 25 are moved by the mechanism 26 in a predetermined sorting manner whereby the sheets are sorted in a selected order. If the duplex copying mode is selected wherein an image is formed on each side of the sheet, the flapper 19 is switched to direct the sheet to the intermediate tray side. By this, the sheet having an image on its one side is introduced by the feeding belt 23 to the intermediate tray 22, where the sheets are stacked. Upon completion of the image formation on one side of each of the sheets, the sheets on the intermediate tray 22 are fed out thereof by the pick-up roller 29 from the trailing edge thereof (switched back). By this operation, the sheet is again brought to the photosensitive member 3 with its uncopied side facing up and receives another image from the photosensitive member on that side. The sheet is similarly advanced to the fixing device 17, but is discharged to the sorter 20 by the flapper 19, and the sheets are sorted in a preset order.

FIG. 2 is another exemplary prior art copying apparatus 1'. Similarly to the foregoing copying machine 1, this copying machine 1' comprises an original carriage 2, cassettes $C_1$ and $C_2$, a lens system LE and a unit 10 including a photosensitive member 3, a developing device 5, a cleaner 6 and a charger 7. Further, the copying machine comprises a feeding device 13 and a fixing device 17 etc. The sheet passage leading from the output of the fixing device 17 is branched into two passages, one of which is a reversing guide passage 32 provided with a feeding roller 34, the other of which leads to a sorter 20' through a passage 35. Further, there is provided a passage 37 which is effective to receive the sheet from the reversing guide passage 32 by way of a flapper 36. The passage 37 is provided with a number of discharge openings 37*a*, through whcih the sheets are introduced to the intermediate tray 22' in accordance with the sizes of sheets. The sheet sorter 20' is separate from the copying machine 1', but is fixed to the machine by proper means, such as screws. The sorter 20' has a number of trays 25'. Flappers 41 and feeding rollers 42 are provided in association with respective trays 25' in the passage 40 communicated with the discharging roller 39 of the machine 1'.

In operation, the sheet which has received the image from the photosensitive member 3 and which has been image-fixed, is introduced to the passage 31. When the simplex copy mode is selected, the flapper 33 is switched to the passage 35 side, so that the sheet is advanced from the discharging roller 39 to the sorter 20'. The sheets are stacked on the trays 25' in a preset sorting manner by the flappers 41 and the feeding roller 42 of the sorter 20'. In the case of duplex mode, the flapper 33 is switched to the reversing guide passage 32 side, and therefore, the sheet having an image on its one side fed through the passage 31 is guided to the passage 32. Then, the feeding roller 34 is reversed to switch back the sheet. The reversed sheet is guided by the flapper 36 and is discharged to the intermediate tray 22' through the passage 37, whereby simplex copy sheets are stacked on the intermediate tray 22'. The sheets on the intermediate tray 22' is fed out by the pick-up roller 29 and the feeding roller 30 with the uncopied side thereof facing up, to the photosensitive member 3 at the transfer station, where another image is transferred onto the uncopied side of the sheet. The sheet now having the images on both sides is then advanced to the sorter 20', by which the sheets are sorted on the trays 25'.

Both of the copying machines or a particular duxple copying machines require a particular intermediate tray 22 or 22', which must be disposed at a particular incline in order to ensure the stacking and feeding of the sheets. Further, it is required to provide a reversing mechanism such as the reversing guide passage 32 in addition to the intermediate tray, which requires a large space, with the result that the space used only for duplex copying is large. Therefore, the entire apparatus including the sorter 20 and 20' becomes bulky. Additionally, as shown in FIGS. 1 and 2, when the duplex copying structures are contained in the copying machine, the machine must be more rigid in order to maintain the large construction, with the result that the machine is heavy.

Furthermore, since the sheet conveying passage is long and complicated throughout the copying machine, the duplex copying structure and the sorter, the position where the sheet possibly jams scatters widely, and therefore, a longer time has to be consumed to located the position of jam occurrence. Also, since the intermediate tray and associated passages and feeding mechanism for the copying are within the apparatus, it is not possible to see the position of jam occurrence from outside, and therefore, it is necessary to open a cover or the like, thus making the trouble disposal cumbersome. As described with the prior art machines, the intermediate trays 22 and 22' are located near the bottom, that is, near the floor, which will make more difficult the jam disposal.

The intermediate trays 22 and 22' receive simplex copies, which are often curled due to the pressure and heat applied thereto during the image fixing step. When they are re-fed therefrom, a so-called double feed can occur, whereby the reliability of the entire system is not increased to a sufficient extent, still involving the disadvantages of bulkiness and complicated structure.

On the other hand, it is another and additional trend that the copying machines are designed for personal use. To meet this, the size, weight and cost are limited with the result of less number of functions available. For example, the sheet feeding passage is single, or only manual feeding mechanism is provided. In such a personal type copying machine, a small-sized sorter, an optional cassette or document feeder or the like are availble if desired by the user. However, those accessories have their own functions only. When those accessories are mounted to the machine, the entire machine becomes quite bulky and costly, although the main machine is small sized and inexpensive. Accordingly, the advantages of the personal type machine can not be enjoyed.

Because the copying machine has now multiple functions and is made systematic, editing and bookbinding operations are carried out using a copying machine having sorting and duplex copying functions. During such operations, it is sometimes required to interrupt the operations and to take another copy by manual feed or the like. In order to allow this, the copying machine is provided with an interruption function or a manual feeding mechanism. However, such machines are inconvenient, since upon interruption the pre-loaded sheets only are availble, namely, it is not possible to take a copy on a different sheet or in a different scale. With a copying machine equipped with a plurality of feeding devices or manual feeding mechanisms, the scale or sheet can be changed, but such a copying machine is large-sized and costly, whereby the users capable of using such machines are limited. In the copying machine not having such functions, the loaded sheet is exchanged, or the manual feeding operation has to be repeated a number of times as required. In the actual use of a copying machine, it is sometimes required that the nature and number of the sheets are checked for each of several departments. When the number of the departments is small, the cassette exclusively for the respective departments can be set in the machine in parallel. However, when the number of departments is large, and/or the nature of the sheets vary widely, it is not practically possible to preset the cassettes in the machine. To meet this, it may be considered to design the machine so that it can be loaded with a number of sheet feeding devices. However, that is not practical since the machine unavoidably becomes bulky, heavy, complicated in structure and costly.

SUMMARY OF THE INVENTION

It is a principal object of the present invention to provide a sheet stacking device or an image forming apparatus provided with the same, which is reliable and easy to handle.

It is another object of the present invention to provide a sheet stacking device or an image forming apparatus provided with the same, which is small in size and less costly in manufacturing.

It is a further object of the present invention to provide a sheet stacking device or an image forming apparatus provided with the same, which is suitable for multi-functions.

It is a further object of the present invention to provide a sheet stacking device or an image forming apparatus provided with the same with which the sheet checking can be easily performed even when a number of kinds of sheets are used.

In one embodiment of the present invention, the sheet stacking device is provided with sheet re-feeding means associated with at least one bin tray of a sorter, and is provided with sheet feeding means for conveying to the image forming station the sheet re-fed by the re-feeding means. The copying machine provided with the device is capable of performing a duplex copying and/or a superimposed copying in addition to a sorting function with the advantages that the conventionally required intermediate tray and the reversing passage are not necessary; that the space occupied by the intermediate tray and that for the reversing passage are not necessary; that the size of the total apparatus can be reduced; that the structure can be simplified and can be made light; and that the manufacturing cost of the apparatus can be decreased. Since the sorting function, duplex copying function and superimposed copying function can be performed using commonly the bin trays, the travel of the sheet can be easily confirmed externally, and the trouble disposal operation (such as a jam) is not different depending on the used functions. The disposal operations are simple so as to enhance the easiness of handling. Further, since the sheet is re-fed from the bin tray or bin trays of the sorter through the sheet feeding portion to the image forming station, the portion where the sheet can relatively easily be jammed can be located at relatively upper position, and the sheet can be re-fed with certainty by the re-feeding means. Therefore, the reliability of the image forming apparatus itself can be increased, and simultaneously the handling thereof can be made easier. The stacking device can be easily attached to a personal use type (copying) machine. Further, the bin tray or bin trays of the sorter can be used as sheet feeding means (cassette), so that the multi-funtion can be accomplished in the personal type machine without destroying the advanges of the personal use machine.

In another embodiment of the present invention, the bin tray associated with sheet re-feeding means or the bin trays other than the aforementioned bin tray are pivotable so that the sheet accommodating space on the bin tray associated with the re-feeding means can be expanded. Even when the trouble such as sheet jamming occurs at the time of re-feeding the sheet by the re-feeding means, the operator can easily find access to the jamming, whereby the trouble can be easily disposed of.

The device can be easily attached to a personal use type copying machine, and one sheet stacking device according to this embodiment makes possible the multi-function operations. Particularly, in the case of superimposed copying operation, the sheet having an image formed on its one side is reversed using the bin tray of the sheet sorter, and then the sheet which now faces down is stacked on another bin tray, and thereafter the sheet is re-fed to the image forming station. Because of this, it is not necessary to provide a particular sheet reversing mechanism, and therefore, the superimposed copying function can be provided by using a small sized sheet stacking device which can be attached to a personal use copying machine. Further, each of the bin trays of the sheet stacking device can be used as sheet feeding means (cassette), so that the multi-function is accomplished without destroying the advantages of the personal type machine.

In a further embodiment, the sheets are re-fed sequentially from the most upstream bin tray with respect to the direction of the sheet re-feeding travel. On account of this feature, the sheet which has been re-fed from the sheet stacking device and has been duplex-copied or superimposedly copied and then is returning to the bin tray of the sorter, does not interfere with another sheet which is being re-fed for the purpose of the duplex or superimposed copy. Therefore, the re-feeding operation is not obstructed by the returning sheet after the duplex or superimposed copy operation, whereby the time required for the re-feeding can be reduced. Accordingly, the sheet re-feeding operation can be harmonized with the copying process.

In a further embodiment of the present invention, each of the bin trays of the sheet stacking device is utilized as a sheet feeding device. Because of this feature, the editing or bookbinding operations can be interrupted, and a copy can be taken on a different sheet or in a different scale with ease. Additionally, all but one bin tray are usable as the feeding device. For this reason, sheet checking can be very easily accomplished when the sheets are classified depending on departments, or when various kinds of sheets are used.

In a further embodiment of the present invention, since the sheet stacking device has the bin trays which re-feed the sheets, the portion where the sheet jams relatively frequently occurs can be located at an upper position, and the sheet can be re-fed by the re-feeding means with certainty. This, enhances the reliability of the unit itself and the ease of handling of the device. Also, the device can be easily attached to a personal use copying machine, and the multiple function can be accomplished by using a single sheet stacking device of this embodiment.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Various embodiments of the present invention will be described in conjunction with the accompanying drawings.

First Embodiment

Figure 3:
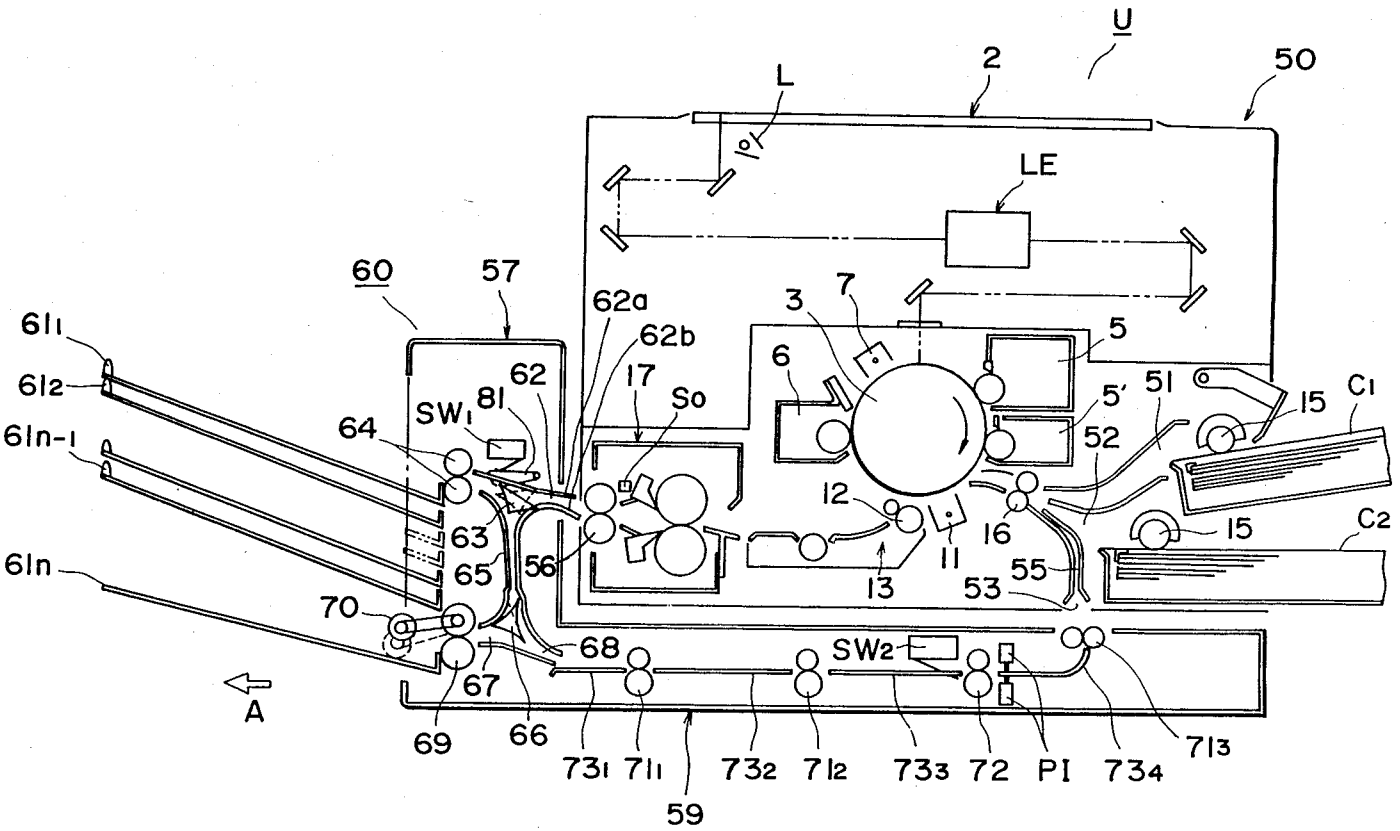
FIG. 3 is a sectional view of an apparatus according to a first embodiment of the present invention.

FIGS. 3, 4, 5 and 6 illustrate the first embodiment of the present invention. The copying machine U, as shown in FIG. 3, comprises a main assembly 50 constituting a copying station (image forming station), which includes an original carriage 2, a light source L, a lens system LE and two cassettes $C_1$ and $C_2$. The main assembly 50 further includes a cylindrical photosensitive member 3, around which a sensitizing charger 7, two developing devices 5 and 5' containing respective toner particles which are different in color, a transfer charger 11 adjacent an inlet end of a feeding device 13 and a separation roller 12. Adjacent the cassettes $C_1$ and $C_2$, pick-up rollers 15 and 15 are disposed. The sheets are guided through passages 51 and 52 to a pair of registration rollers 16. To the registration rollers 16, there is provided another passage 55 from a guiding inlet 53 which opens downwardly. In the vicinity of the outlet end of the feeding device 13, there is a fixing device 17. At the outlet side of the fixing device 17, a pair of discharging rollers 56 is provided to discharge the sheet from the copying machine. Also provided there, is a sensor $S_0$ for detecting passage of the sheet.

A sheet stacking device 60 includes a sheet sorter 57 and a sheet feeder 59 which are disposed adjacent the main assembly 50 of the copying apparatus. The sorter 57 is provided with a number (n−1) of vertically movable bin trays $61_1$, $61_2$–$61_{n-1}$ for accommodating the sheets. An additional bin tray $61_n$ is disposed at the bottom. The sorter 57 has a passage 62 alignable with the discharging rollers 56 of the main assembly and has a first flapper 63 and a pair of discharging rollers 64 which are effective to discharge the sheets to the movable bin trays $61_1$–$61_{n-1}$. The movable trays $61_1$–$61_{n-1}$ are as a whole movable up and down by a known driving mechanism including a reversible motor and a slot cam (Japanese Patent Application Publication No. 78769/1981, for example). A passage 65 is formed leading from the branch where the first flapper 63 is provided to a branch where a second flapper 66 is provided, by which the passage 65 is selectively connected to the fixed tray $61_n$ through a passage 67 or to a feeder 59 through a passage 68 The passage 67 is provided with a second pair of discharging rollers 69 for discharging the sheet to the fixed tray $61_n$. Between the discharging rollers 69 and the fixed tray $61_n$, there is a re-feeding roller 70.

The sheet feeder 59 includes top and bottom frames which are connected by unshown side plates. Three pairs of feeding rollers $71_1$, $71_2$ and $71_3$ are rotatably supported on the side plates. Between the second and third pairs of feeding rollers $71_2$ and $71_3$, there is a pair of adjusting rollers 72 which will be described hereinafter. Further, between adjacent pairs of rollers, guide plates $73_1$, $73_2$, $73_3$ and $73_4$ are provided to guide the sheet. The third pair of feeding rollers $71_3$ is aligned with the inlet opening 53 of the main assembly 50. Outside the side plates of the sheet feeder 59, guide rails which will be described hereinafter are fixed, and they serve as a guide when the sheet stacking device 60 is detached from the main assembly in the direction indicated by an arrow A and also to position the feeding rollers $73_3$ and the passage 62 with the inlet opening 53 and the discharging rollers 56, respectively.

Figure 4:
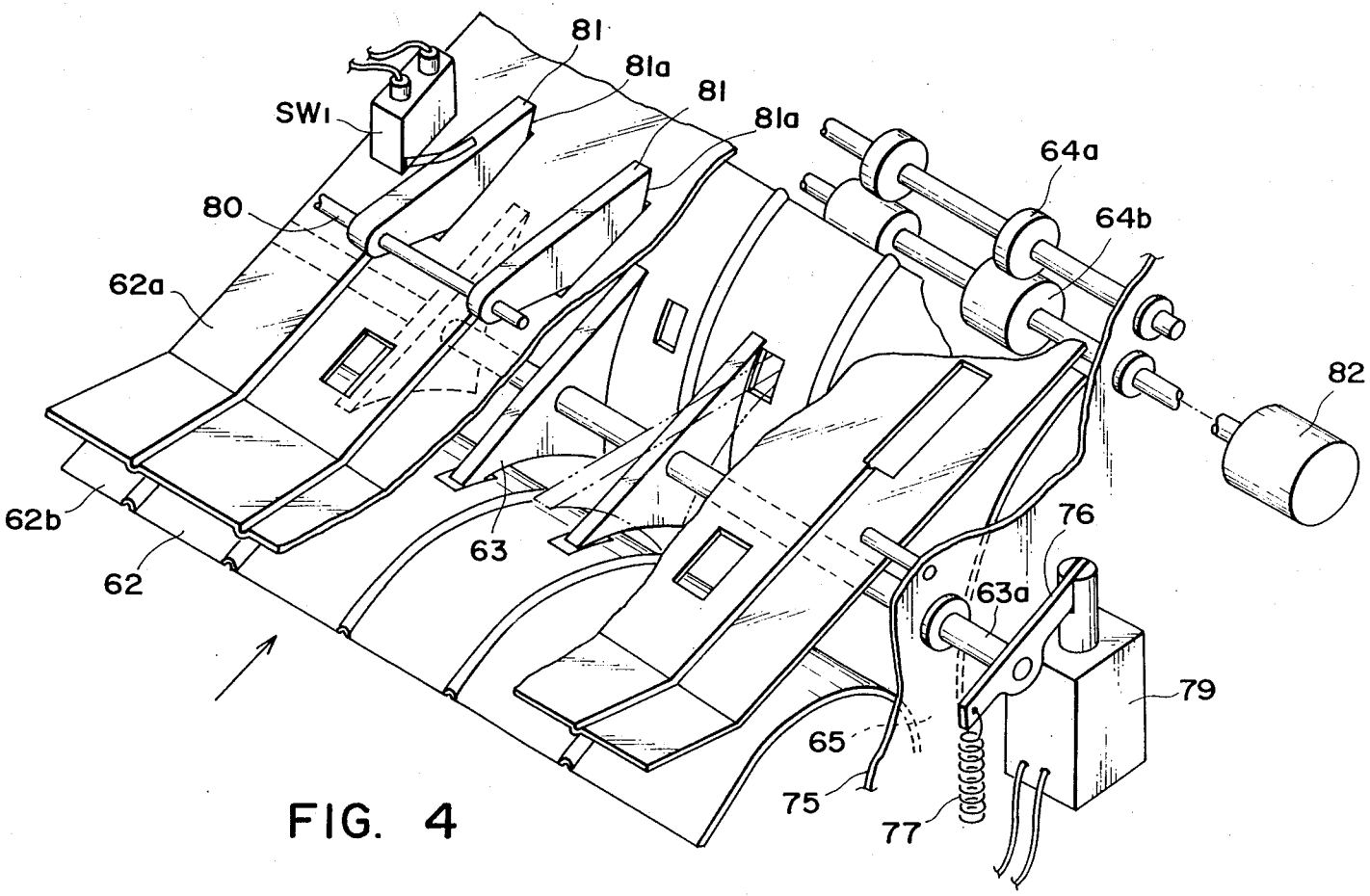
FIG. 4 is a perspective view illustrating et passage switching mechanism of the apparatus of FIG. 3.

As shown in FIG. 4, an upper guiding plate 62*a* and the lower guiding plate 62*b* constituting the passage 62 are secured to and between side plates 75. Between the upper and lower guide plates 62*a* and 62*b*, a shaft 63*a* is disposed and rotatably supported on the side plates 75. The first flapper 63 is fixed to the shaft 63*a*. The shaft 63*a* has an end to which an arm 76 is fixed. The arm 76 has an end which is tensioned by a spring 77 so that the first flapper 63 is normally urged to the position shown by the solid lines wherein the passage 62 is communicated with the discharge roller couple 64. The other end of the arm 76 is operatively coupled to a solenoid 79, by which the first flapper 63 is switched to a position shown by the chain lines wherein the passage 65 is communicated with the passage 65. The upper guide plate 62*a* has apertures through which a number of auxiliary guide members 81 extend into the passage 62. The auxiliary guide members 81 are mounted rotatably on a shaft 80 which is extended between the side plates 75. The guide members 81 each have a perpendicular part 81*a*. The auxiliary guide members 81 serve to allow the sheet to pass to the discharging rollers 64 and also to guide the sheet returned from the discharging rollers 64 to the passage 65. A microswitch $SW_1$ is provided in association with one of the auxiliary guide members 81. The switch $SW_1$ is activated when the auxiliary guide members 81 pivot upwardly about the shaft 80 due to the sheet passing through the passage 62, so that the passage of the sheet is detected.

The first discharging roller pair 64 includes upper rollers 64*a* and lower rollers 64*b*. The lower rollers 64*b* are fixed on a shaft which is rotatably supported through the side plates 75. The shaft is operatively connected to the output shaft of a reversible DC motor 82. The upper rollers 64*a* are fixed on a shaft which is operatively coupled with the lower shaft by gears.

A second flapper 66, similarly to the first flapper 63, is urged by a spring to communicate the passage 65 to the second discharging rollers 69, and is operatively connected to a solenoid so as to be switched to communicate the passage 65 to the passage 68.

Figure 5:
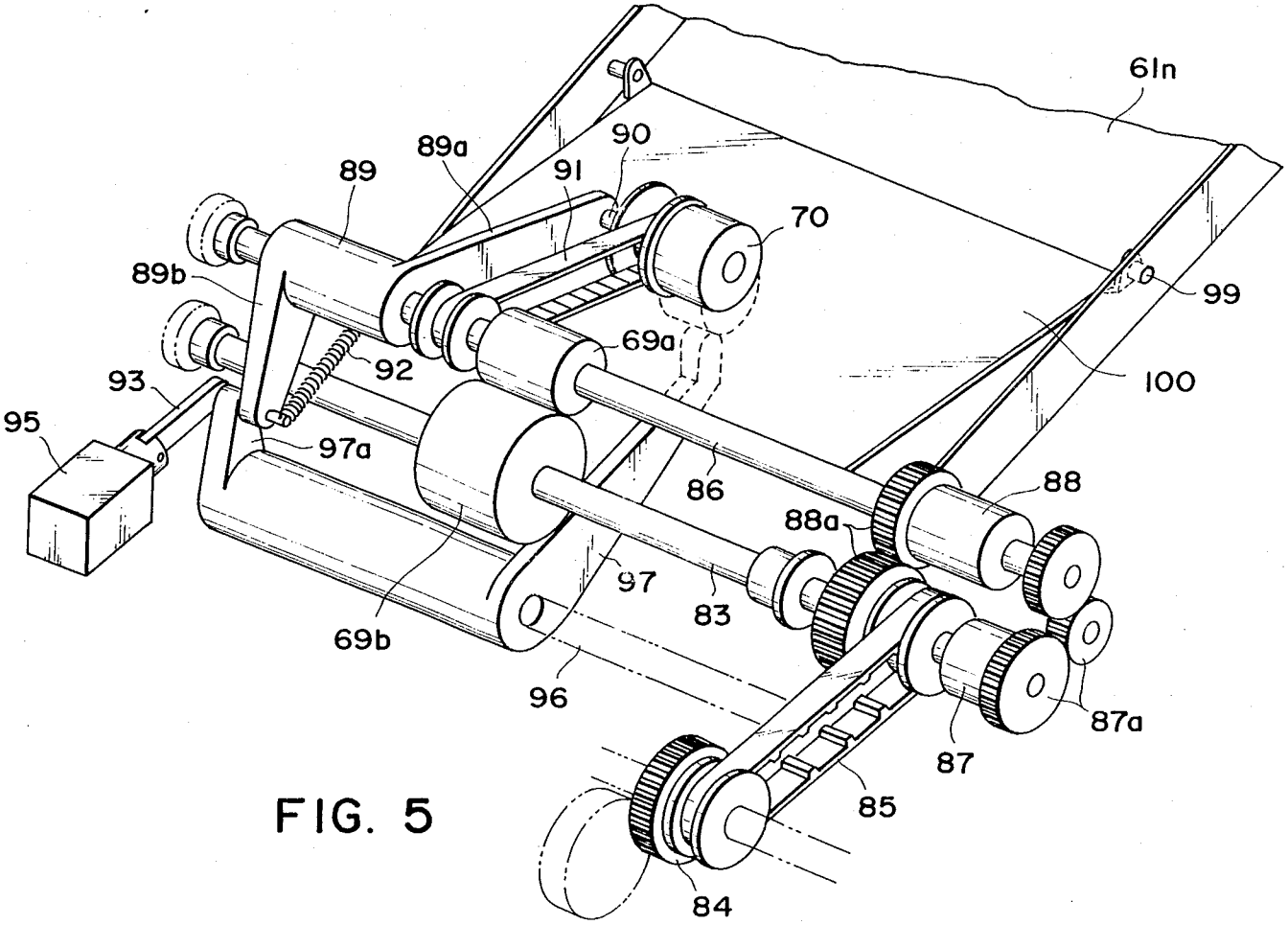
FIG. 5 is a perspective view illustrating the structure around a sheet re-feeding mechanism of the apparatus of FIG. 3.

As shown in FIG. 5, the second discharging roller pair 69 include upper rollers 69*a* and lower rollers 69*b*. The lower rollers 69*b* are fixed to a shaft 83 which is rotatably supported through the side plates 75. The lower rollers 69*b* are operatively connected to a driving source through a timing belt 85 and a gear 84 so that they are driven together with the feeding rollers $71_1$–$71_3$ in the opposite directions, that is, the lower rollers 69*b* are rotated counterclockwise and the lower parts of the feeding rollers are rotated clockwise, as seen in FIG. 3. A shaft 86 to which the upper rollers 69*a* are mounted is interrelated with the lower roller shaft 83 through a spring clutch 87, a gear train 87*a*, a spring clutch 88 and a gear grain 88*a*. The shaft 86, and therefore, the upper rollers 69*a* are driven in opposite directions by switching the spring clutches 87 and 89 although the lower roller shaft 83 rotates in the forward direction at all times. To the upper roller shaft 86, a bell crank 89 provided with arms 89*a* and 89*b* is rotatably supported. The re-feeding roller 70 is rotatably supported on an end of the arm 89a by a shaft 90. The shaft 90 is interrelated with the upper roller shaft 86 through a timing belt 91 so that the re-feeding roller 70 can be rotated in the same direction as and in synchronism with the upper roller 69a. A spring 92 is stretched from an end of another arm 89b of the bell crank 89. To the same end, a solenoid 95 is coupled through a link 93, which is effective to pull the end against the force of the spring 92. A shaft 96 is extended between the side plates and supports a back-up link 97. An end of the link 97 is formed into an arm 97a which is connected through a long whole or the like to a solenoid link 93 together with the arm 89b. The back-up link 98 extends toward the fixed tray $61_n$ below the re-feeding roller 70 so as to be contacted to a bottom surface of an auxiliary plate 100 pivotably supported by a pin 99 to the base of the fixed tray $61_n$. By this structure, the auxiliary plate 100 pivots upwardly in response to the re-feeding roller 70 moving down, so as to assist the re-feeding of the sheet on the auxiliary tray 100.

Figure 6:
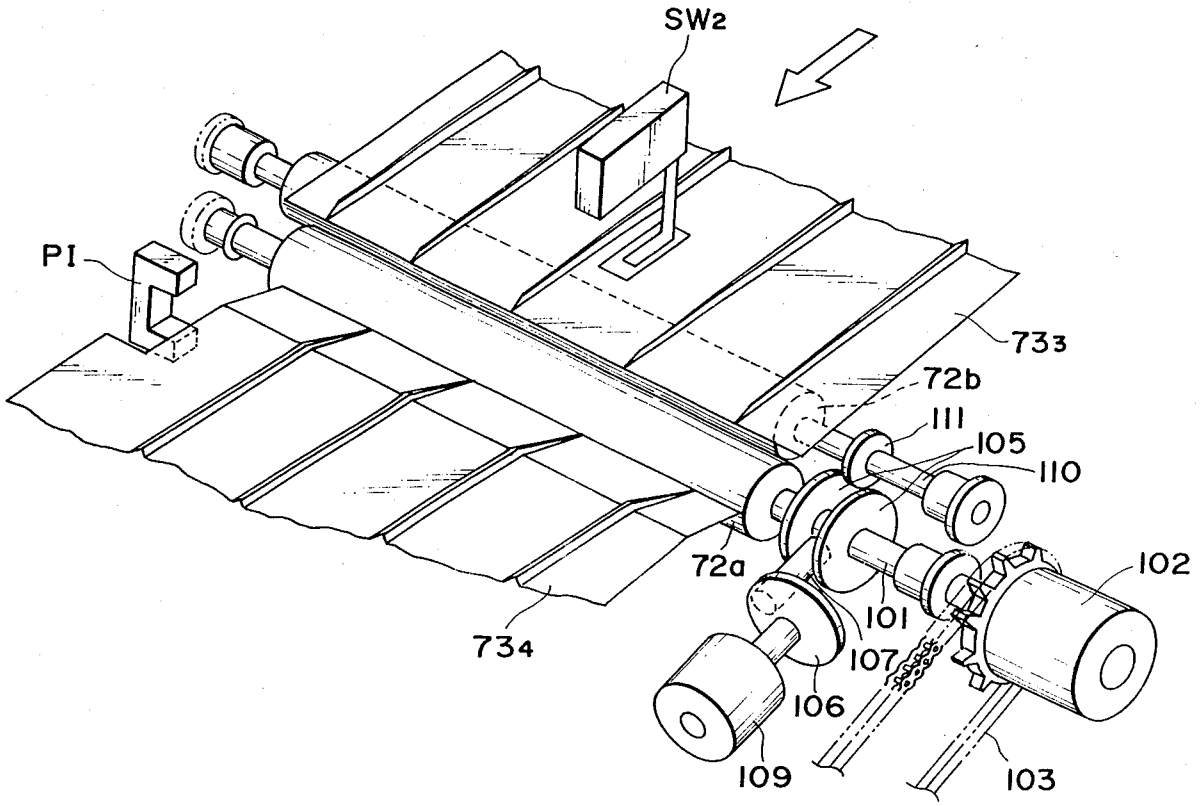
FIG. 6 is a perspective view of the structure around an adjusting roller of the apparatus shown in FIG. 3.

As shown in FIG. 6, the pair of adjusting rollers 72 includes a driving lower roller 72a and a following upper roller 72b. A spring is stretched to urge those rollers toward each other to grip the sheet. The lower rollers 72 are splined on a shaft 101 extended between the side plates, and the shaft 101 is interrelated with a driving chain 103 through an electromagnetic clutch 102. The lower roller shaft 101 has two circular disks 105 supported thereon for movement together with the lower roller 72a as a unit. Between the disks 105, a pin 107 fixed on another circular disk 106 is engaged. A servo motor 109 is fixed to a side plate of the frame. The output shaft of the motor 109 is connected to the disk 106, so that when the motor 109 rotates, the lower roller 72a slides on the shaft 101. The follower upper roller 72b is supported on the roller shaft 110 for sliding movement and has at its one end a disk 111 fixed thereto. The disk 111 is engaged with the guide plate 105, and therefore, the upper roller 72b is slidable in the axial direction together with the lower roller 72a. A microswitch $SW_2$ is provided to the top surface of the guide plates $73_3$ slightly upstream of the adusting roller couple 72 with respect to movement of the sheet. The switch $S_2$ has an actuator which is lifted by the sheet passing by the guiding plate $73_3$, whereby the passage of the sheet is detected. A photointerrupter PI is disposed interposing a cut-away portion of the guide plate $73_4$ slightly downstream of the adjusting roller couple, the photointerrupter PI being effective to detect a lateral end portions of the sheet by the interruption of the light.

The lower rollers of the feeding roller pair $71_1$, $71_2$ and $71_3$ are driven by a main driving source of the sheet feeder 59 through a driving chain 103 or the like. The upper rollers associated therewith are interrelatedly driven through gears.

The operation of the apparatus according to this embodiment will be described.

Firstly, the description will be made as to a sorting operation mode wherein copies are made on a number (n) of sheets, which are then sorted in a predetermined order.

The sheet on one side of which an image is formed, is conveyed to the discharging rollers 56 and is discharged thereby to the passage 62 of the stacking device 60. At this time, the first flapper 63 occupies the solid line position as shown in FIG. 3, and the movable trays $61_1$–$61_{n-1}$ take the lowermost position wherein the first tray $61_1$ is faced to the discharging rollers 64. This is the initial setting. The first sheet from the passage 62 is discharged to the first tray $61_1$ and stacked there. When n copies of originals (Page a–Page z) are to be taken and sorted, the first copy sheet of Page a is received by the first tray $61_1$, and immediately thereafter, the trays are shifted up so that the second tray $61_2$ is aligned with the discharging roller couple 64. Then, the second copy sheet of the same page of the original is received by the second tray $61_2$. The same operations are repeated until the (n−1)th sheet is received on the (n−1)th tray $61_{n-1}$. Then, the solenoid 79 is energized to switch the first flapper 63 to such a position as to lead to the first flapper 63 and as to switch the second flapper 66 to such a position as to lead to the fixed $61_n$. Therefore, the (n)th copy sheet of Page a of the original is discharged by the discharging rollers 69 and is received by the fixed tray $61_n$. At this time, the re-feeding roller 70 takes its upper position indicated by solid lines in FIG. 3 so as not to interfere with the discharging sheet. In the same manner n copy sheets are stacked on the trays $61_1$–$61_n$. By repetition, n sets of copies from Page a through Page z are stacked on the trays.

Next, the duplex copying operation will be described.

When the operator inputs "n" as a number of duplex copies and actuates the copy button, the sorter is reset to the initial conditions, if necessary. And, the first flapper 63 takes the chain line position by energization of the solenoid 79 so as to lead the sheet to the passage 65, and the second flapper takes the solid line position. When the sheet on one side of which an image is formed, which will be called "simplex copy sheet" hereinafter,is conveyed to the discharging rollers 56 and to the passage 62, it is guided by the first flapper 63 to the passage 65 and then guided by the second flapper 66 to the passage 67. At this moment, the spring clutch 87 is disengaged, and the spring clutch 88 is engaged so as to rotate the lower roller 69b and the upper roller 69a through the gear train 88a in such directions as to be cooperative to discharge the sheet to the fixed tray $61_n$. The solenoid 95 is not energized, and the spring 92 maintains the re-feeding roller 70 at its upper position. Therefore, the sheet led to the passage 67 is discharged by the discharging rollers 69 to the fixed tray $61_n$. These operations are repeated n times, and n simplex copy sheets are stacked on the fixed tray $61_n$. When the (n)th simplex copy sheet passes, the trailing edge thereof is detected by a sensor $S_0$ of the main assembly. With a time delay properly set for the last sheet to arrive at and be stacked on the fixed tray $61_n$, the apparatus automatically stops the simplex copy operation to prepare for the other side copy operation. The rotation of the discharging rollers 69 of the stacking device 60 also stops. A duplex copy signal for starting image formation on the other sides is generated. The solenoid 95 is energized to rotate the bell crank 89 in the clockwise direction so as to lower the re-feeding roller 70 and to rotate the back-up link 97 in the counterclockwise direction to raise the auxiliary plate 100. The lower roller shaft 83 is rotated in the forward direction by the timing belt 85 and the related mechanism. The spring clutch 87 is engaged, while the spring clutch 88 is disengaged, so that the backward rotation force is applied to the upper roller shaft 86. By this, the upper roller 69a rotates in a direction to move the sheet from the fixed tray $61_n$ to the passage 67. Through the timing belt 91, the re-feeding roller 70 rotates in the same direction. Therefore, the simplex sheets stacked on the fixed tray $61_n$, more particularly, the auxiliary plate 100, are fed by the refeeding roller 70 to the discharging rollers 69, further to the passage 67. The sheet is guided by the second flapper 66 and guided to the passage 68 and further to the feeding roller $71_1$ of the sheet feeder. If there is a tendency for double feed, the forward rotation of the lower roller **69*b* is effective to separate out the topmost sheet contacting the upper roller 69*a* and re-feed the sheet only. After the sufficient time has passed for the sheet to be gripped by the roller couple $71_1$, the solenoid 95 is deenergized to allow the re-feeding roller 70 to rise, and the spring clutch 87 is disengaged, while the spring clutch 88 is engaged so that a forward rotation force is applied to the upper roller 69*a* through the gear grain 88*a*, whereby the refeeding of the second sheet is deferred. On the other hand, the first sheet fed out is advanced by the feeding roller couples $71_1$ and $71_2$ to arrive at the detection switch $SW_2$ which is actuated thereby. Then, the electromagnetic clutch 102 is deenergized so that the adjusting roller couple is once stopped just before it grips the sheet, whereby the sheet forms a curl on the guide plate $73_3$ between the feeding rollers $71_2$ and the adjusting rollers 72. After a predetermined period of time, the driving clutch 102 is energized again to start rotation of the adjusting rollers 72, thus removing the possible inclination of the sheet with respect to the guide plate which is caused when the sheet is re-fed. Then, the servo motor 109 is driven in the direction of the axis of the adjusting rollers 72 while they are holding the sheet, until a lateral end of the sheet is detected by the photointerrupter PI, thereby adjusting the lateral deviation of the sheet. If the photointerrupter PI does not detect the sheet a predetermined time after the re-actuation of the adjusting rollers 72, it is discriminated that the sheet is deviated toward the rear side (righthand side as seen in FIG. 6), and the adjusting rollers 72 are moved toward front side (lefthand side as seen in FIG. 6) until the photointerrupter PI detects the sheet. On the other hand, where before the predetermined period of time elapses after the re-actuation of the adjusting rollers 72, the photointerrupter PI detects the sheet, it is discriminated that the sheet is deviated to the front side, and the adjusting rollers 72 are once moved toward the rear side until the sheet is out of the photoinerrupter PI, and then to the front side. After the inclination and the lateral deviation are corrected and after a predetermined period of time has passed from the re-actuation of the adjusting rollers 72, the driving force to the sheet feeder 59 is stopped to stop the sheet feeding, and the feeder waits for the feeding signal from the main assembly 50. After the operator does necessary work such as replacing the original, the actuation switch of the apparatus 50 is rendered on, so that the sheet feeder 59 is driven by the driving motor in timed relation with the main assembly 50. By this, the adjusting rollers 72, $71_3$ rotate again so as to feed the sheet into the passage 55 through the inlet 53. A toner image is transferred by the charger 11 from the photosensitive member 3 to a fresh side of the simplex copy sheet. The toner image is then fixed by the fixing device 17. The duplex copy sheet now bearing the image on both sides thereof is discharged by the discharging roller couple 56 to the stacking device 60. The sorter 57** sorts the duplex copy sheets in the preset order on the trays $61_1$–$61_n$.

Next, description will be made with respect to the superimposed copy wherein two images are copied superimposedly on one side of the sheet, When the operator inputs "n" as a number of superimposed copies and actuates the copy button, the first discharging rollers 64 are rotated forwardly, and the first flapper 63 and the second flapper 66 are set in the solid line positions. Further, the trays $61_1$–$61_{n-1}$ are set at the lowermost position. When the first copied sheet is discharged by the discharging rollers 56 to the passage of the sheet stacking device 60, the sheet is guided by the first flapper 63 to the first discharging roller pair 64, which rotates forwardly to advance the tray $61_1$. When it travels to the passage 62, the leading edge thereof raises the auxiliary guide members 81. By the guide members 81, the detection switch $SW_1$ is actuated to sense the passage of the sheet. When the trailing edge passes by the auxiliary guide members 81, the members 81 reset by its own weight, so that the detection switch $SW_1$ is rendered off at the position where the discharging rollers 64 grips the trailing edge portion of the sheet. Then, the reversible motor 82 is reversed, so that the first discharging rollers 64 are reversed, and the sheet is fed from the tray side to the flapper 63. At this time, the leading edge (the trailing edge before the sheet is fed back) is abutted to and guided by the perpendicular portion **81*a* of the guide member 81 to the passage 65. The time period (T) during which the switch $SW_1$ is on is measured by a clockpulse counter whereby the length of the sheet is determined. The count (T) plus a margin (a) is subtracted from the same counter from the start of reverse rotation of the first discharging rollers 64. The time when the subtraction ends, is deemed as the sheet departing from the discharging roller couple 64. After this, the DC motor 82** is rotated forwardly to prepare for the next sheet.

On the other hand, the first sheet conveyed to the passage 65 is guided by the second flapper 66 and is conveyed to the second discharging rollers 69. The second discharging rollers 69 rotate for forward transportation because of the state of the spring clutch 88, and the re-feeding roller 70 is at the upper position, with the result that the sheet is discharged onto the fixed tray $65_n$ by the discharging rollers. Since in the superimposed copy, the sheet is once reversed (switched back) by the first discharging rollers 64, the sheets stacked on the fixed tray $65_n$ are faced down. The above-described operations are repeated n times to stack n sheets on the fixed tray $61_n$, and thereafter, the sheet feeder 59 is driven in the same manner as in the duplex copy so that another copy image is transferred onto the same side of the sheet. As desired, the sorter is used to sort the superimposed copy sheets in a preset manner on the trays $61_1$–$61_n$.

When the operator selects only one superimposed copy, in other words, when he selects the superimposed copy mode without sorting, the solenoid 79 is energized to switch the first flapper 63 to the chain line position, and to switch the second flapper 66 to the chain line position. With those positions, the sheet having a first copy image is introduced into the passage 62 by the discharging rolelr couple 56, and then, the sheet is guided by the flapper 63 to the passage 65. Further, it is guided by the flapper 66 to the passage 68. The sheet is then fed by the sheet feeder 59, and the adjusting rollers 72 correct the inclination and lateral deviation. Subsequently, the sheet is fed to the main assembly 50 where the second image is superimposed. Then, the solenoid 79 is deenergized to restore the first flapper 63 to its solid line position, whereby the superimposed copy sheet is discharged to the topmost tray $61_1$.

Second Embodiment

FIGS. 7, 8, 9 and 10 show the second embodiment of the present invention. Since the ,main assembly 50 of the copying machine is similar that of the first embodiment, the detailed description thereof is omitted for the sake of simplicity by assigning the same reference numerals to the corresponding elements.

Figure 7:
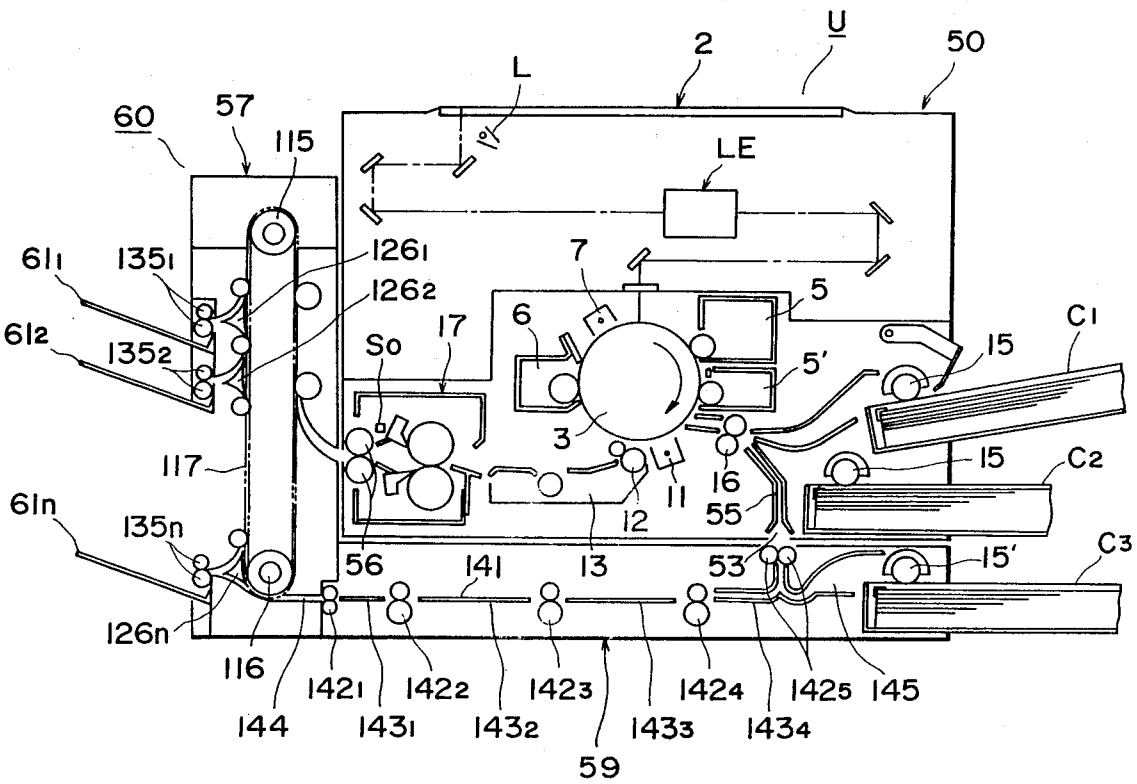
FIG. 7 is a sectional view of an apparatus according to a second embodiment of the present invention.
Figure 8:
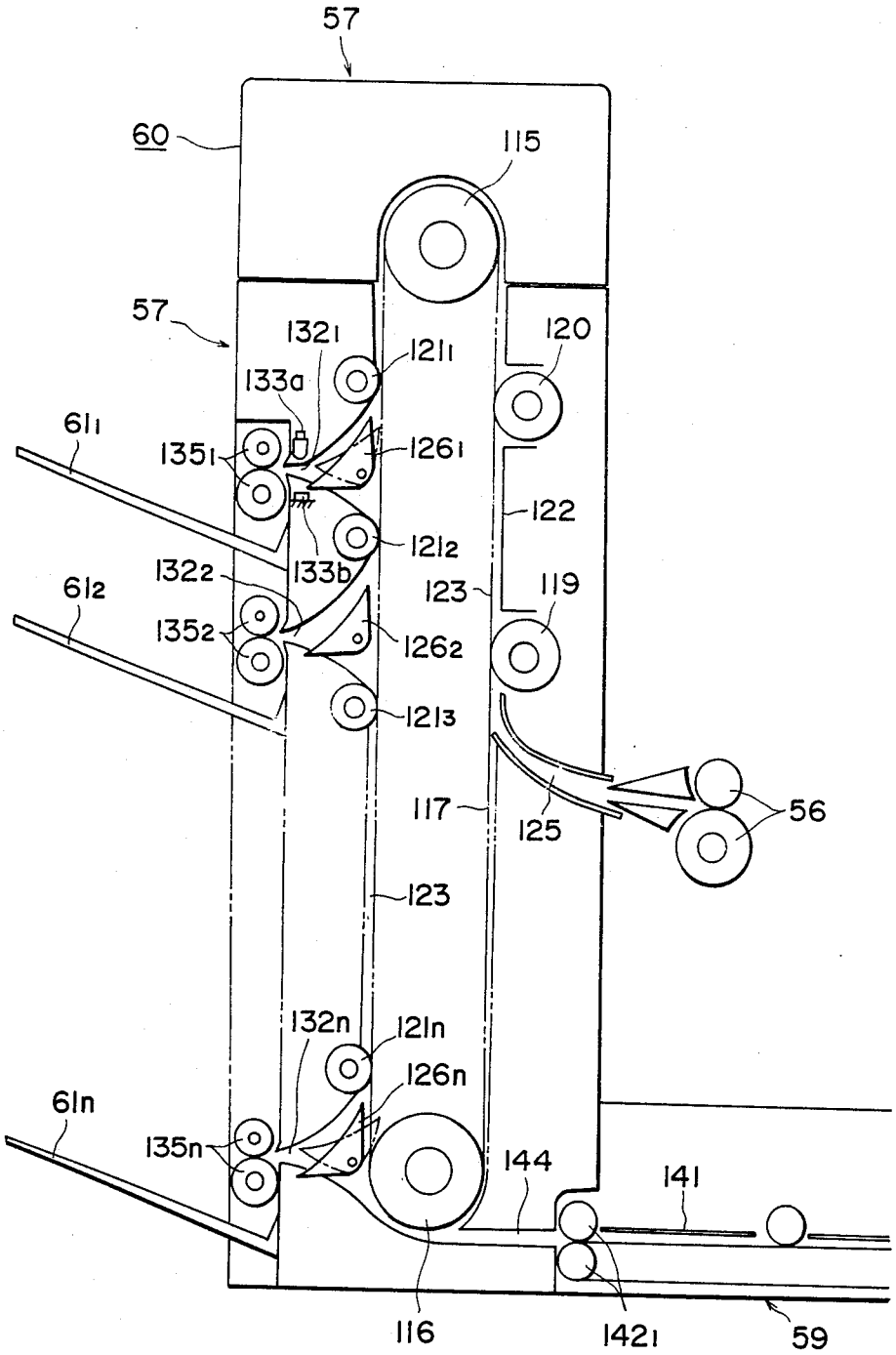
FIG. 8 is a front view of a sorter of the apparatus shown in FIG. 7.

As shown in FIG. 7, the sheet-stacking device 60 comprises a sorter 57 and a sheet-feeder 59. The sorter 57 is provided with a number of bin trays $61_1$–$61_n$ and top and bottom pulleys 115 and 116, each of which is rotatably supported on the side plates. Around the pulleys 115 and 116, a belt 117 is operatively arranged. Further, as shown in FIG. 8, a number of conveying rollers 119, 120, $121_1$–$121_n$ are disposed at predetermined intervals and resiliently contact to the belt for rotation by the belt, thus constituting a sheet conveying passage 123. Communicated with the passage 123 is a passage 125 for receiving the sheet from the discharging rollers 56 of the main assembly of the copying machine. To the passage 123, a number (n) of flappers $126_1$–$126_n$ are faced which can direct the sheet to the trays $61_1$–$61_n$.

Figure 9:
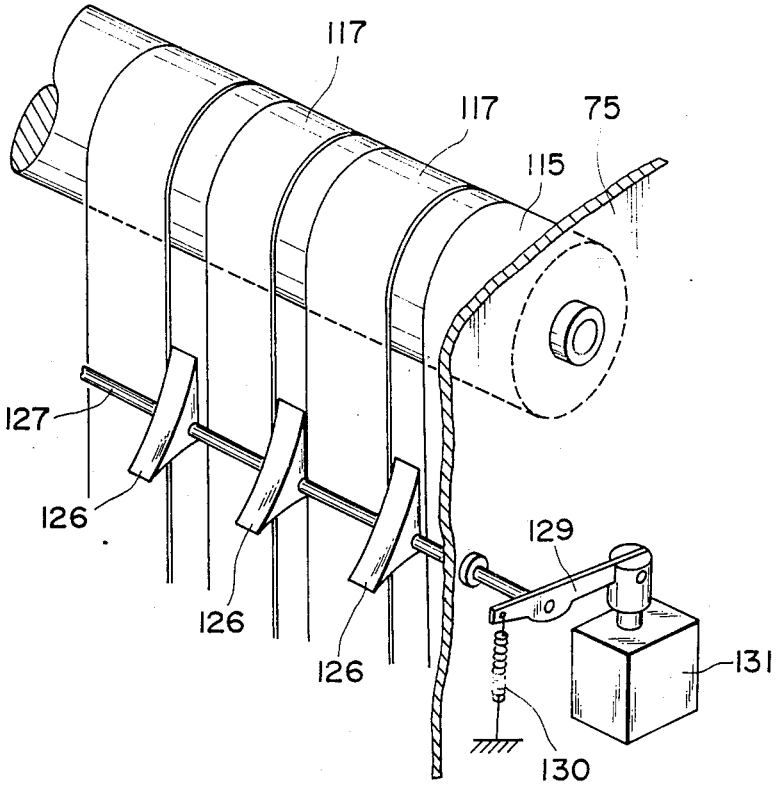
FIG. 9 is a perspective view illustrating the structure around the sheet passage switching mechanism of the apparatus shown in FIG. 7.

As shown in FIG. 9, each of the flappers $126_1$–$126_n$ is fixed on a shaft 17 which is rotatably supported on side plates 75. The shaft has an arm 129 fixed thereto. A spring 130 and solenoid 131 are connected to the respective ends of the arm 129. The spring 130 urges the flapper to the direction leading the sheet to the passage 123 which is along the belt 117 and closing the passage to the passage 132. When the solenoid 131 is energized, the sheet is guided to the tray passage 132 by the flapper. Each of the passages $132_1$–$132_n$ leading to the associated tray is provided with a sheet detecting sensor 133 comprising a light emitting element **133*a* and a photoreceptor element 133*b***. Further, each of the passages $132_1$–$132_n$ is provided at an end thereof with a couple of discharging roller ($135_1 135_n$).

Figure 10:
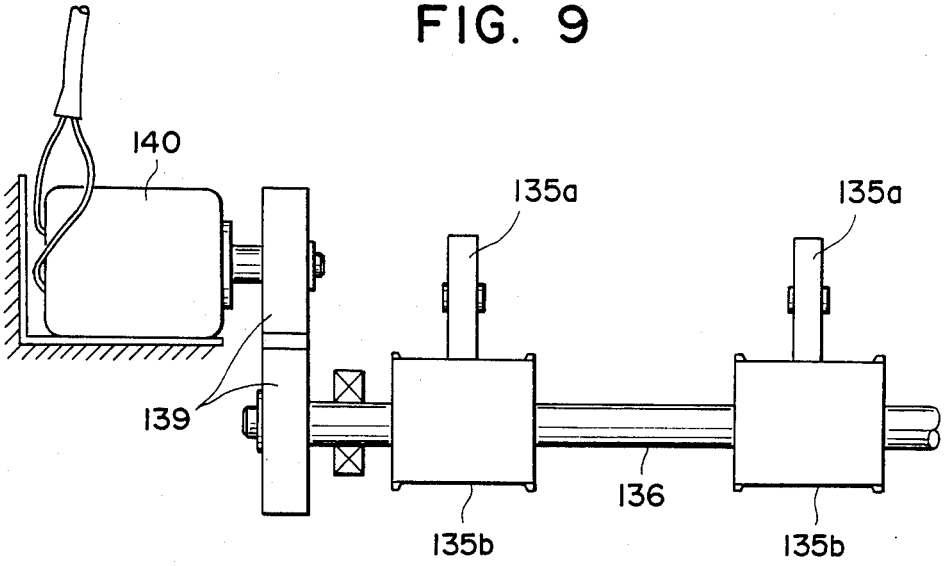
FIG. 10 is a side view of the structure around discharging rollers of the apparatus of FIG. 7.

As shown in FIG. 10, each of the discharging pairs of rollers include an upper roller **135*a* and the lower roller 135*b*. The lower roller 135*b* is fixed to a shaft 136 rotatably supported on side plates, while the upper roller 135*a* is press-contacted to the lower roller 135*b* and is driven thereby. Each of the lower roller shafts 136 is operatively connected through a gear 139 to a reversible geared motor 140**, thus constituting sheet re-feeding means for re-feeding the sheet stacked on the trays $61_1$–$61_n$.

The shaft for supporting the bottom pulley 116 is connected to a driving source such as a motor, which functions also as a driving source of the shaft feeder 59. The sheet feeder 59 has a passage 141 aligned with a discharging passage 144 extending from the passage 123. The passage 141 is provided with a number of pairs of rollers $142_1$–$142_5$ driven by the driving source through a gear train, chain or the like and with the guide plate $143_1$–$143_4$ therebetween. Of these roller pairs, the intermediate roller pairs $142_3$ and $142_4$ include a so-called inclined roller pair to correct the lateral position of the sheet to that of a reference position. The final roller pair $142_5$ is aligned with the inlet 53 of the main assembly of the copying machine. To the other end of the sheet feeder 59, a third cassette $C_3$ can be loaded. From the cassette $C_3$, the sheet is guided to the final feeding roller pair $142_5$ through the passage 145 by the feeding roller 15'.

The operation of this embodiment will be described. The description of the operation in the sorting mode will be omitted since it is similar to that of a conventional machine.

First, a duplex copying mode will be described wherein m pages of sheet originals are copied, and n copies are produced for each.

When the operator inputs "n" as a number of duplex copies and actuates the copy button of the copying machine 50, the first page of the original is copied on a copy sheet, which is discharged from the discharging roller couple 56 to the passage 125 of the stacking device 60. When the sheet sensor $S_0$ disposed adjacent the discharging rollers 56 downstream of the fixing device 17, detects the passage of the sheet leading edge, a signal is inputted to a microprocessor MPU which then produces a signal for actuating a solenoid 131 for the first flapper $126_1$. Then, the flapper $126_1$ is switched so as to communicate the passage 123 to the first tray passage $132_1$ (chain line position in FIG. 8), and the motor 140 for the first discharging roller pair $135_1$ receives a forward rotation signal from the microprocessor MPU, so that it rotates forwardly to discharge the sheet toward the tray $61_1$. Therefore, the first sheet is fed by the belt 117 and feeding rollers 119, 120 and $121_1$, and guided by the first flapper $126_1$ to the discharging rollers $135_1$, by which it is discharged toward the first tray $61_1$. When the sheet sensor 133 detects the sheet leading edge in the tray passage $132_1$, the microprocessor MPU produces a signal for stopping the motor 140 after the time period corresponding to the length of the sheet elapses, whereby the first discharging roller pair $135_1$ stops while gripping the trailing edge portion of the sheet. When the second sheet is detected by the sensor $S_0$, the first flapper $135_1$ is restored to the solid line position (FIG. 8) so that the tray passage $132_1$ is isolated, and simultaneously, the second flapper $135_2$ is switched to a position for connecting the passage 123 to the tray passage $132_2$. The second discharging roller pair $135_2$ is rotated forwardly. Similarly to the first sheet, the second sheet is stopped with its trailing end portion gripped and held by the second discharging rollers $135_2$. Similarly, the third sheet is gripped by the discharging rollers $135_3$. This continues until the (n)th sheet is gripped by the discharging rollers $135_n$.

Then, the original is replaced by Page 2 and the copy operation is resumed. The first flapper $126_1$ is switched to the chain line position (FIG. 8), and the motor 140 for the first discharging roller pair $135_1$ rotates backwardly. Then, the first sheet gripped by the discharging roller pair $135_1$ is transported through the passages 123 and 144 to the sheet feeder 59, where it is transported through the feeding rollers $142_1$–$142_5$ to the inlet 53 of the main assembly of the copying apparatus. The sheet receives another image on the side which has not been copied, and the duplex copy sheet is discharged through the discharging rollers 56 to the sheet stacking device 60. At this time, the sensor $S_0$ detects the passage of the sheet similarly, in response to which the first discharging roller pair $135_1$ is rotated forwardly, and the first flapper $126_1$ is kept in the position for leading the sheet to the tray passage $132_1$. Therefore, the duplex copy sheet is guided by the flapper $126_1$ to the discharging roller pair $135_1$, by which it is discharged onto the first tray $61_1$. This time, the sheet sensor 133 detects that the sheet has passed through the discharging roller pair $135_1$, and the discharging roller couple $135_1$ stops after the sheet is placed completely on the first tray $61_1$.

Similarly, the second sheet gripped by the second discharging roller pair $135_2$ is transported to the main assembly in which another image is formed on the sheet at the fresh side thereof. The sheet is then discharged to the second tray $61_2$. This continues until the (n)th sheet is copied duplex and discharged to the (n)th tray $61_n$.

The above-described overall operations are repeated for the original from third page to (m)th page. Finally, n sheets for each of m pages of the originals are stacked on the respective trays to complete the copying operation.

Next, the operation in the superimposed copying mode will be described. Similarly to the duplex copy case, simplex copy is gripped and held by the discharging roller pairs $135_1$–$135_{n-1}$. In this mode, the bottommost tray $61_n$ (not limited to the bottommost one) is used exclusively for receiving the sheet, and therefore, it is not used for stacking the sheets. When a second original is placed on the original carriage 2, and the switch is actuated, the first flapper $126_1$ is switched to the chain line position (FIG. 8). Also, the first discharging roller pair $135_1$ is reversed so as to feed the sheet gripped by the roller pairs $135_1$ to the passage 123. Simultaneously with the actuation of the switch of the main body, the (n)th flapper $126_n$ is switched to the chain line position (FIG. 8), and the (n)th discharging roller pair $135_n$ is kept rotating forwardly. Therefore, the sheet conveyed by the belt 117 through the passage 123 is guided by the (n)th flapper $126_n$ to the discharging roller pair $135_n$, by which it is directed to the tray $61_n$ by the forward rotation of the discharging roller pair $135_n$. Similarly to the above-described, the leading edge of the sheet is detected by the detecting sensor 133. After the time period corresponding to the length of the sheet has passed therefrom, the motor 140 stops to stop the discharging rollers $135_n$ while gripping the trailing edge portion of the sheet. Subsequently, the motor 140 is reversed so as to feed the sheet gripped thereby to the passage 123. By this, the sheet is inversed in its face orientation and reversed in its moving direction, and fed from the passage 144, the switch-back passage in this case, to the passage 141 of the sheet feeder 59 with its copied side facing down. The feeding rollers $142_1$–$142_5$ of the feeder 59 feed the sheet through, the inlet 53 to the main assembly, where another image is superimposed on the same side. Similarly to the case of duplex copy mode, the superimposed copy is discharged to the first tray $61_1$. The same operation is repeated for the second sheet gripped by the second discharging roller pair $135_2$ and is stacked on the second tray $61_2$. Those operations are repeated for the rest of the sheets until (n−1) sheets are superimposedly copied.

Third Embodiment

Figure 11:
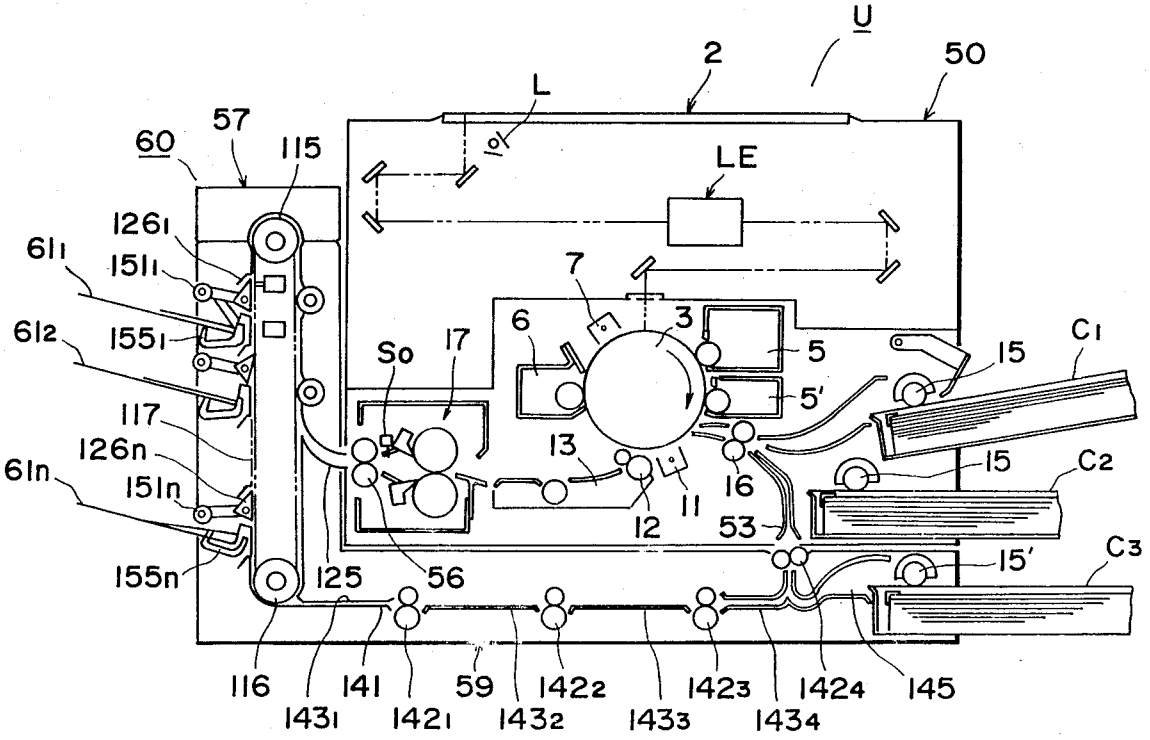
FIG. 11 is a sectional view of an apparatus according to a third embodiment of the present invention.
Figure 12:
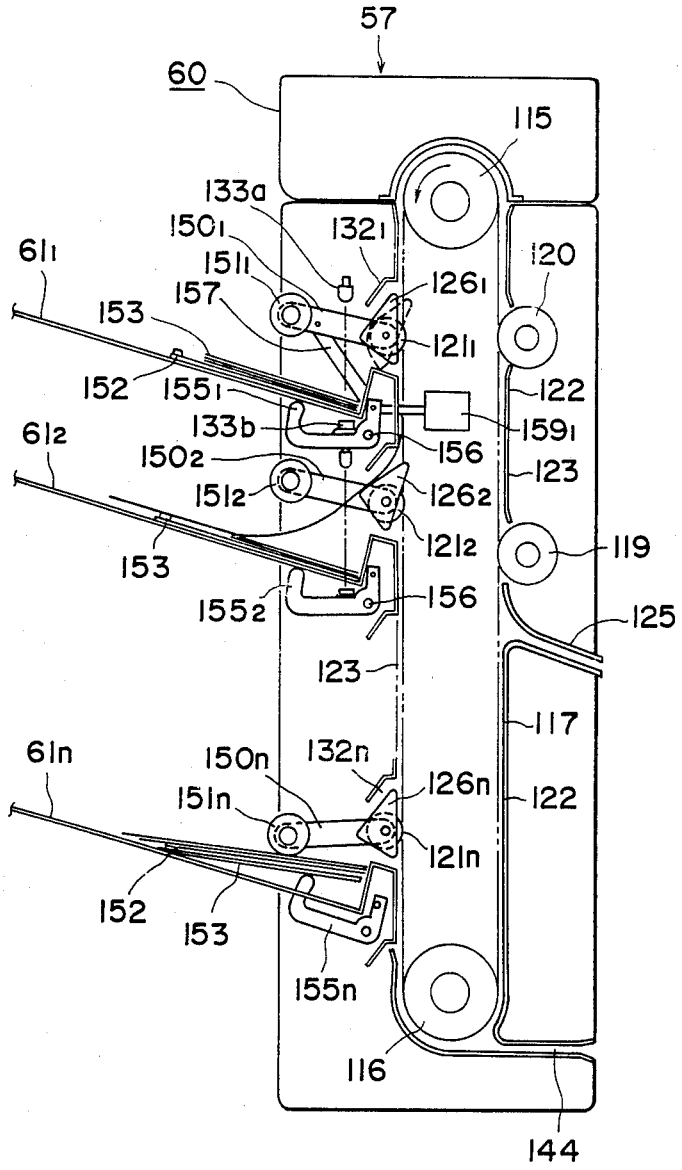
FIG. 12 is a front view of a sorter of the apparatus shown in FIG. 11.
Figure 13:
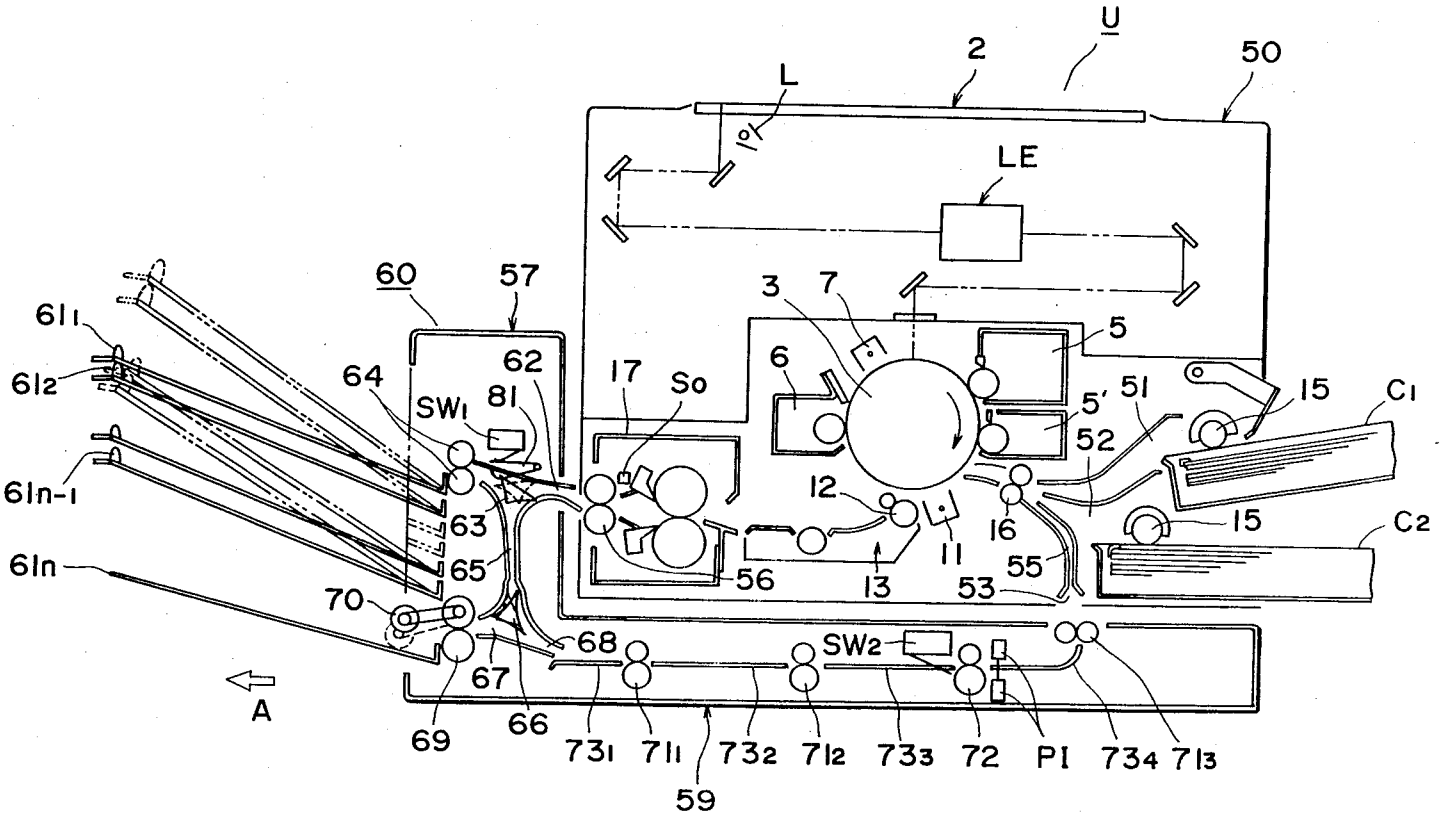
FIG. 13 is a sectional view of an apparatus according to a fourth embodiment of the present invention.

FIGS. 11 and 12 illustrate the third embodiment of the present invention. Since the structures of the main assembly 50 of the copying apparatus are similar to the first embodiment, the detailed explanation is omitted for the sake of simplicity by assigning the same reference numerals to the corresponding elements.

As shown in FIG. 11, the sheet stacking device 60 comprises a sorter 57 and a sheet feeder 59. The sorter 57 is provided with a number of bin trays $61_1$–$61_n$ and top and bottom pulleys 115 and 116. Around the pulleys 115 and 116 a belt 117 is operatively arranged. Further, as shown in FIG. 12, a number of conveying rollers 119, 120, $121_1$–$121_n$ are disposed at predetermined intervals and resiliently contacted to the belt for rotation following the belt, thus constituting a sheet conveying passage 123. Guide plates 122 are between the rollers. Communicated with the passage 123 is a passage 125 for receiving the sheet from the discharging roller couple 56 of the main assembly of the copying machine. To the passage 123, a number (n) of flappers $126_1$–$126_n$ are faced, which can direct the sheet to the trays $61_1$–$61_n$, respectively. Each of the flappers $126_1$–$126_n$ is rotatably supported on the shaft of each of the feeding rollers $121_1$–$121_2$. Like the second embodiment, each of the flappers 126 is movable between a solid line position and a chain line position. A spring is provided to urge normally to the solid line position whre the sheet is prevented from advancing toward the tray and is allowed to advance to the passage 123 along the belt 117. A solenoid 131 is provided, which is effective when energized to lead the sheet to the tray passage 132. Each of the trays $61_1$–$61_n$ is provided with a light emitting element 133*a* and a photoreceptor element 133*b* which constitute a sheet detecting sensor 133. Arms $150_1$–$150_n$ are rotatably supported on the feeding rollers $121_1$–$121_n$. Re-feeding rollers $151_1$–$151_n$ are mounted adjacent an end portion of each of the arms. The arms are normally urged in the clockwise direction by an unshown spring so as to keep the re-feeding rollers away from the tray. Each of the re-feeding rollers $151_1$–$151_n$ is interrelated by an unshown chain or gear grain with the associated feeding roller ($121_1$–$121_n$), so that they rotate in synchronism with rotation of the rollers $121_1$–$121_n$ in the direction for advancing the sheet to the passage 123.

Each of the trays $61_1$–$61_n$ is provided with an auxiliary plate 153 which is pivotable about a pin 152 mounted to the bottom thereof. To the bottom surface of the auxiliary plate 153, a back-up link $155_1$–$155_n$ is rotatably supported on the shaft 156. An end arm of the back-up link and the supporting arm $150_1$–$150_n$ of the re-feeding roller is interconnected by a link $157_1$–$157_n$. When the arm 150 is pivotted downwardly (counterclockwise direction), the back-up link 155 pivots upwardly (clockwise). A solenoid $159_1$–$159_n$ is coupled to an end arm of each of the back-up links $155_1$–$155_n$, whereby upon energization of the solenoid, the re-feeding rollers $151_1$–$155_n$ and the auxiliary plate 153 are switched to re-feeding positions (the bottommost tray $61_n$ of FIG. 12).

Like the second embodiment, the shaft for supporting the bottom pulley 116 is connected to a driving source such as a motor, which functions also as a driving source of the sheet feeder 59. The sheet feeder 59 has a passage 141 aligned with a discharging passage 144 extending from the passage 123. The passage 141 is provided with a number of roller couples $142_1$–$142_5$ driven by the driving source through a gear train, chain or the like and with the guide plates $143_1$–$143_4$ therebetween. Of these roller couples, the intermediate roller couples $142_3$ and $142_4$ include a so-called inclined roller couple to correct the lateral position of the sheet to a reference position. The final roller couple $142_4$ is aligned with the inlet 53 of the main assembly of the copying machine. To the other end of the sheet feeder 59, a third cassette $C_3$ can be loaded. From the cassette $C_3$, the sheet is guided to the final feeding roller $142_4$ through the passage 145 by the feeding roller 15'. The operation of this embodiment will be described. Firstly, the description will be made with respect to a duplex copy mode wherein n copies are produced from m pages of originals.

When the operator inputs "n" as a number of duplex copies and actuates the copy button of the copying machine 50, the first page of the original is copied on a copy sheet, which is discharged from the discharging roller couple 56 to the passage 125 of the stacking device 60. When the sheet sensor $S_0$ disposed adjacent the discharging roller couple 56 downstream of the fixing device 17, detects the passage of the sheet leading edge, a signal is inputted to a microprocessor MPU which then produces a signal for actuating a solenoid 131 for the first flapper $\mathbf{126_1}$. Then, the flapper $\mathbf{126_1}$ is switched to communicate the passage 123 to the first tray passage $\mathbf{132_1}$ (chain line position in FIG. 8). Therefore, the first sheet is fed by the belt 117 and feeding rollers 119, 120 and 121, and guided by the first flapper $\mathbf{126_1}$ to the first tray 611 through the tray passage $\mathbf{132_1}$. When the second sheet is detected by the sensor $S_0$, the first flapper $\mathbf{126_1}$ is restored to the solid line position (FIG. 12) so that the tray passage $\mathbf{132_1}$ is isolated, and simultaneously the second flapper $\mathbf{135_1}$ is switched to a position for connecting the passage 123 to the tray passage $\mathbf{132_2}$. Similarly to the first sheet, the second sheet is discharged onto the second tray $\mathbf{61_2}$. In the similar manner, the third sheet is discharged to the third tray $\mathbf{61_3}$, and this continues until the (n)th sheet is discharged to the (n)th tray $\mathbf{61_n}$.

Then, the original is replaced by the second page and the copy operation is resumed. All the flappers $\mathbf{126_1}$–$\mathbf{126_2}$ are restored to the solid line positions (FIG. 12) for leading the sheet to the passage 123 (actually however, the flappers are sequentially restored so that the (n)th flapper $\mathbf{126_n}$ is restored finally). Then, the first solenoid $\mathbf{159_1}$ is urged so that the back-up link $\mathbf{155_1}$ is rotated clockwise to raise the auxiliary plate 153, and the arm $\mathbf{150_1}$ is rotated counterclockwise through the link $\mathbf{157_1}$ to bring the re-feeding roller $\mathbf{151_1}$ into contact with the sheet on the tray $\mathbf{61_1}$. By the rotation of the re-feeding roller $\mathbf{151_1}$, the sheet is fed to the passage 123. The sheet is directed to the sheet feeder 59 through the passage 144. In the feeder 59, the feeding roller couples $\mathbf{142_1}$–$\mathbf{145_4}$ advance the sheet to the inlet 53 of the main assembly 50, where the uncopied side of the sheet receives a second image, then the duplex copy sheet is discharged to the sheet stacking device 60 through the discharging roller couple 56. When the sheet sensor 133*a* and 13*b* detects that the sheet is discharged from the first tray $\mathbf{61_1}$, the solenoid $\mathbf{159_1}$ is deenergized to shift the re-feeding roller $\mathbf{151_1}$ upwardly and restore the auxiliary plate 153 to the normal downward position. In response to the sensor $S_0$ detecting the passage of the sheet, the first flapper $\mathbf{126_1}$ is kept at a position to lead the sheet to the tray passage $\mathbf{132_1}$. Therefore, the duplex copy sheet is guided by the flapper $\mathbf{126_1}$ to be discharged on the first tray $\mathbf{61_1}$. Similarly, the second sheet supported on the second tray $\mathbf{61_2}$ is transported to the main assembly in which another image is formed on the sheet at the fresh side thereof. The sheet is then discharged to the second tray $\mathbf{61_2}$. This continues until the (n)th sheet is copied duplex and discharged to the (n)th tray.

The above-described overall operations are repeated for the original from third page to (m)th page. Finally, n sheets for each of m pages of the originals are stacked on the respective trays to complete the copying operation.

Next, the operation in the superposed copy mode will be described.

Similarly to the duplex copy case, simplex copy is discharged to the first tray $\mathbf{61_1}$. When a second original is placed on the original carriage 2, and the switch is actuated, the first flapper $\mathbf{126_1}$ is switched to the chain line position (FIG. 12), and the first solenoid $\mathbf{159_1}$ is energized to raise the auxiliary plate 153 of the first tray $\mathbf{61_1}$ and to lower the re-feeding roller $\mathbf{151_1}$, whereby the sheet on the tray $\mathbf{61_1}$ is fed out to the passage 123. Simultaneously with the actuation of the starting switch, the (n)th flapper $\mathbf{126_n}$ is switched to the position for leading the sheet to the tray $\mathbf{132_n}$. Thus, the sheet traveled through the passage 123 by the action of the belt 117 is discharged to the tray $\mathbf{61_n}$ by the (n)th flapper $\mathbf{126_n}$. When the sensor 133 detects that the sheet is on the tray $\mathbf{61_n}$, the (n)th solenoid (not shown) is energized so as to raise the auxiliary plate 153 through the back-up link $\mathbf{155_n}$ and as to lower the arm $\mathbf{150_n}$, so that the re-feeding roller $\mathbf{151_n}$ is contacted to the sheet on the tray $\mathbf{61_n}$, more particularly to the sheet on the auxiliary plate 153. By this, the sheet is conveyed to the passage 123. Then, the sheet is inversed in its face orientation and reversed in its moving direction, and fed from the passage 144, that is, the switch-back passage in this case, to the passage 141 of the sheet feeder 59 with its copied side facing down. The feeding rollers $\mathbf{142_1}$–$\mathbf{142_4}$ of the feeder 59 feed the sheet through the inlet 53 to the main assembly, where another image is copied on the same side superimposedly. Similarly to the case of duplex copy mode, the superimposed copy is discharged to the first tray $\mathbf{61_1}$.

In the foregoing description, the first (the topmost) tray $\mathbf{61_1}$ and the (n)th (the bottommost) tray is used, but it is possible to use other trays.

Next, an operation will be described wherein fresh sheets are supplied from the trays $\mathbf{61_1}$–$\mathbf{61_n}$ to the main assembly 50, that is, the bin trays are used as a feeding device.

The operator stacks fresh copy sheets on one of the trays, such as the bottommost tray $\mathbf{61_n}$ which is determined depending on the department requiring the copies. The operator selects the mode of simplex copy on the sheet from a bin tray and actuates the start switch. Then, the flapper $\mathbf{126_n}$ is restored to the solid line position (FIG. 12) for leading the sheet to the passage 123, subsequently the (n)th solenoid $\mathbf{159_n}$ is energized to pivot clockwise the back-up link $\mathbf{155_n}$ to raise the auxiliary plate 153, and to pivot counterclockwisely the arm $\mathbf{150_n}$ through the link $\mathbf{157_n}$ so as to bring the feeding roller $\mathbf{151_n}$ into the contact with the sheet on the tray $\mathbf{61_n}$. When the feeding roller $\mathbf{151_n}$ is rotated, the sheet on the tray $\mathbf{61_n}$ is fed to the feeding roller $\mathbf{121_n}$ and is fed to the passage 123 by the rotation of the roller $\mathbf{121_n}$. Then, the sheet is transported through the passage 144 and by the belt 117 to the sheet feeder 59, where it is further advanced by the roller couples $\mathbf{142_1}$–$\mathbf{142_4}$ to the inlet 53 of the main assembly 50, where an image of the original placed on the original carriage 2 is transferred and fixed, and then discharged by the discharging roller couple 56 to the passage 125 of the sheet stacking device 60. When the sensor $S_0$ disposed adjacent the discharging roller couple 56 detects the passage of the leading edge of the sheet, a signal is inputted to the microprocessor unit MPU, the microprocessor unit produces a signal for energizing the solenoid of the first flapper $\mathbf{126_1}$, so that the flapper $\mathbf{126_1}$ is switched to the chain line position leading the sheet to the tray passage $\mathbf{132_1}$. Therefore, the copied sheet is transported by the belt 117 and the roller 119 and 120. Further, the sheet is guided by the first flapper $126_1$ and discharged to the first tray 611 through the tray $132_1$. If necessary, the sheet sorting function of the sorter 57 may be used to sort the sheets over the trays $61_1$–$61_{n-1}$ in a preset order.

In the foregoing description, the fresh sheet is supplied from the bottommost tray $61_n$, but this is not limiting, and (n−1) trays out of the bin trays $61_1$–$61_n$ may be selected for this purpose. The copied sheets are discharged to and stacked on the unused tray or trays. By providing a part of the bin trays $61_1$–$61_n$ with cassette supporting member, a cassette is usable.

Fourth Embodiment

FIGS. 13, 14, 15, 16 and 17 illustrate the fourth embodiment of the present invention. Since this embodiment is similar to the first embodiment in some aspects, the detailed explanation is omitted for the sake of simplicity by assigning the same reference numerals to the corresponding elements.

Figure 14:
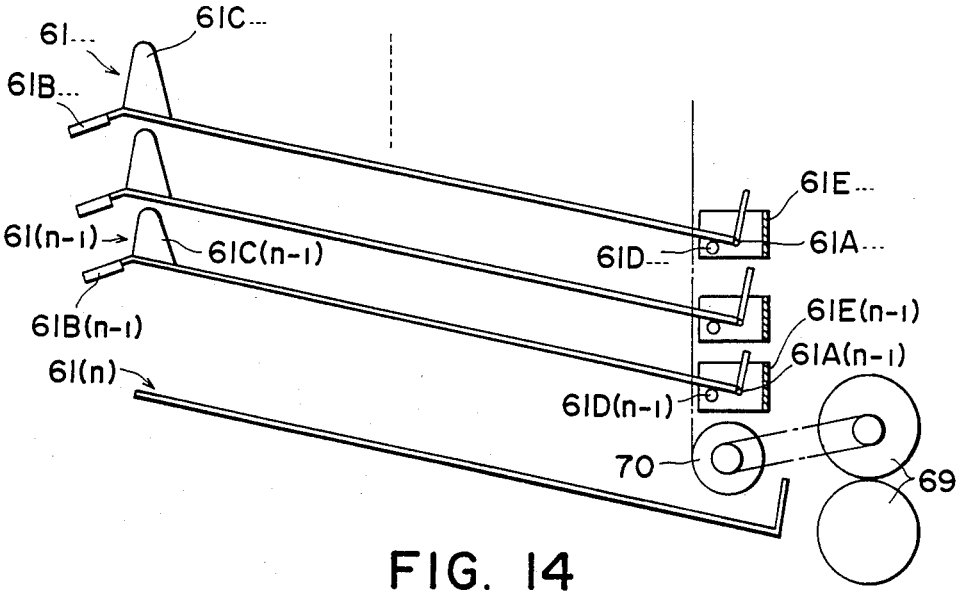
FIG. 14 is a side view illustrating the mounting of the bin trays in the apparatus of FIG. 13.
Figure 15:
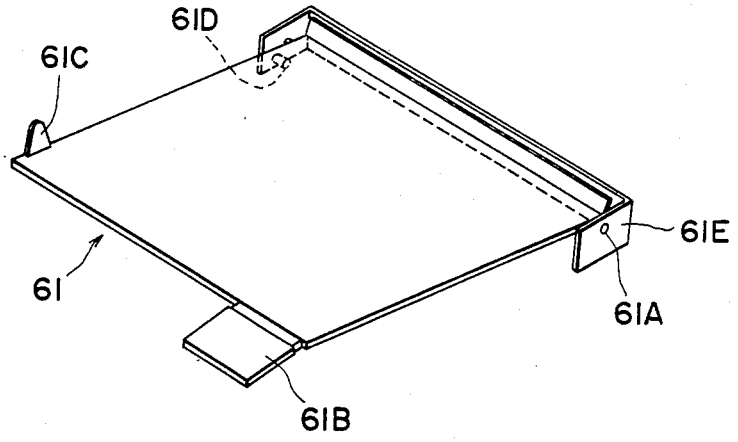
FIG. 15 is a perspective view of the bin trays of the apparatus shown in FIG. 13.
Figure 16:
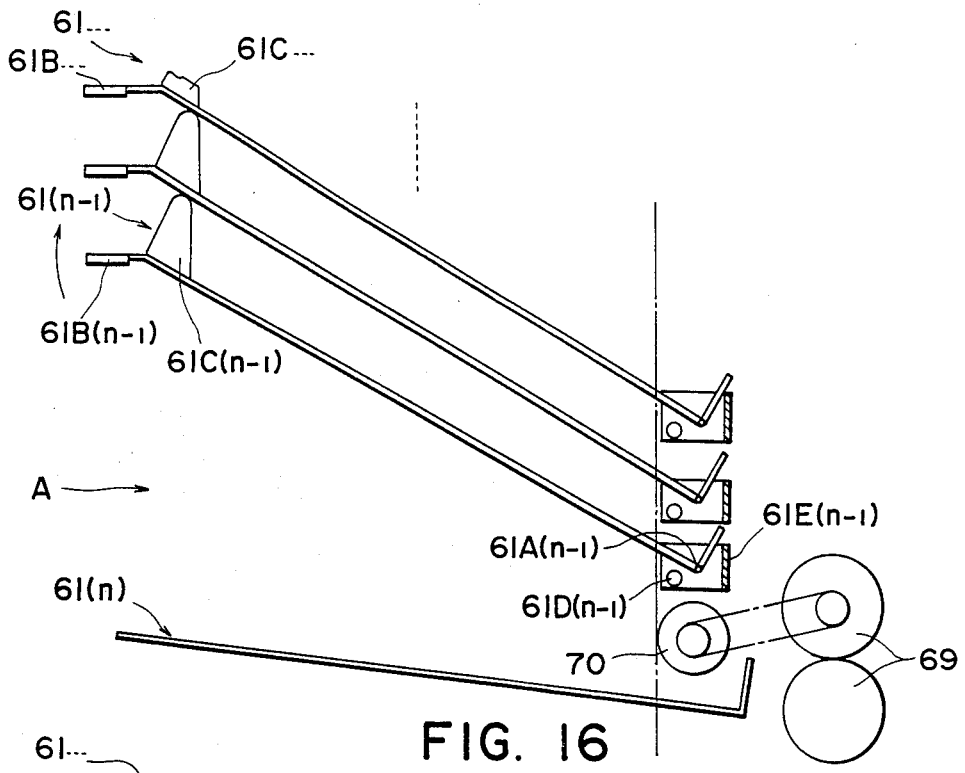
FIG. 16 is a side view of the bin tray pivotted upwardly in the apparatus shown in FIG. 13.

Each of the sheet accommodating bin trays $61_1$–$61_{n-1}$, as shown in FIGS. 14 and 15, has a base portion where it is pivotably mounted by each of pins $61A_1$–$61A_{n-1}$ on each of the frames $61E_1$–$61E_{n-1}$ which are vertically movably supported to the sheet sorter 57. The frames $61E_1$–$61E_{n-1}$ are each provided with positioning tabs $61D_1$–$61D_{n-1}$. Normally, the bottom surfaces of the trays $61_1$–$61_{n-1}$ are contacted to the tabs $61D_1$–$61D_{n-1}$ so that the trays $61_1$–$61_{n-1}$ are supported at a predetermined inclination angle. The end positions of the bin trays $61_1$–$61_{n-1}$ are provided with outwardly extending grips $61B_1$–$61B_{n-1}$ and upwardly extending guides $61C_1$–$61C_{n-1}$. When a bin tray $61_{n-1}$ is pivotted upwardly by the grip $61B_{n-1}$, the upper end of the guide $61C_{n-1}$ raises the bottom surface of the upper bin tray $61_{n-1}$, so that all of the trays $61_1$–$61_{n-1}$ pivot upwardly (FIG. 16).

The description will be made with respect to the disposal of the trouble (such as paper jam), when the sheet stacked on the bin tray $61_n$ is re-fed.

When the sheet is jammed at the re-feeding roller 70 or the discharging rollers 69, that is, in the vicinity of the fixed bin tray, the operator lifts the bottommost movable bin tray $61_{n-1}$ by the grip $61B_{n-1}$ so that the bin tray $61_{n-1}$ is pivotted upwardly about the pin $61E_{n-1}$. Then, the guide $61C_{n-1}$ of the bin tray $61_{n-1}$ is contacted to the bottom surface of the tray $61_{n-1}$. With the rotation of the tray $61_{n-1}$, the upper tray $61_{n-2}$ is also rotated, and similarly, all of the upper trays $61_1$–$61_{n-3}$ are pivoted upwardly, with the result that the trays $61_1$–$61_{n-1}$ are all pivoted upwardly. By this action, the space beween the tray $61_{n-1}$ and the fixed tray $61_n$ are expanded (FIG. 16), the operator can easily access to the sheet accommodating space A above the fixed bin tray $61_n$ and dispose of the jammed paper without difficulty. After the disposal, the operator pivots the tray $61_{n-1}$, by which all the other pivotable trays $61_1$–$61_{n-2}$ are pivoted so that the bottom surfaces thereof are contacted to the positioning tabs $61D_1$–$61D_{n-1}$. Thus, they are supported at the predetermined angle.

Figure 17:
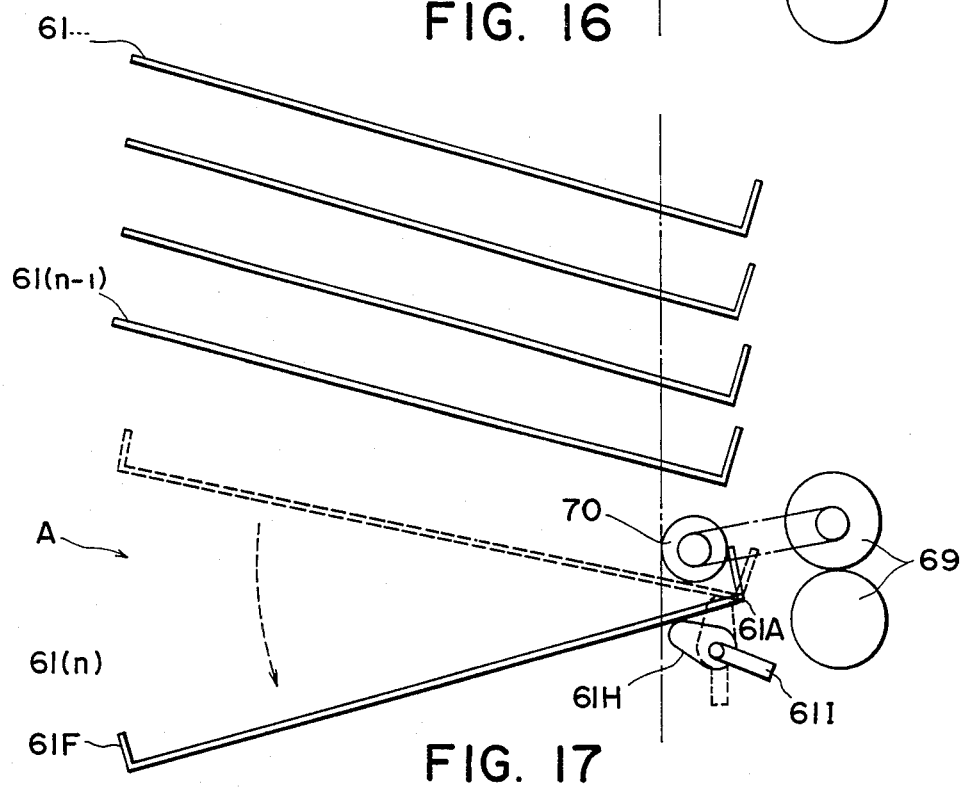
FIG. 17 is a side view of modified bin trays.

In this embodiment, the movable trays $61_1$–$61_{n-1}$ not provided with the re-feeding means 69 and 70 are pivotably supported, but it is possible that, as shown in FIG. 17, the base portion of the fixed bin tray $61_n$ not provided with the re-feeding means is pivotably supported by a pin 61A on the side plates of the sorter, and a tray releasing lever 61H having a grip 61I faced to the fixed bin tray $61_n$. Then, by rotating the lever 61H, the fixed bin tray $61_n$ is pivoted downwardly, thus expanding the space between the movable tray $61_{n-1}$ and the fixed tray $61_n$. Indicated by a reference numeral 61F is a sheet limiting plate for preventing the sheet from falling when the fixed bin tray $61_n$ is pivoted downwardly.

Fifth Embodiment

Figure 18:
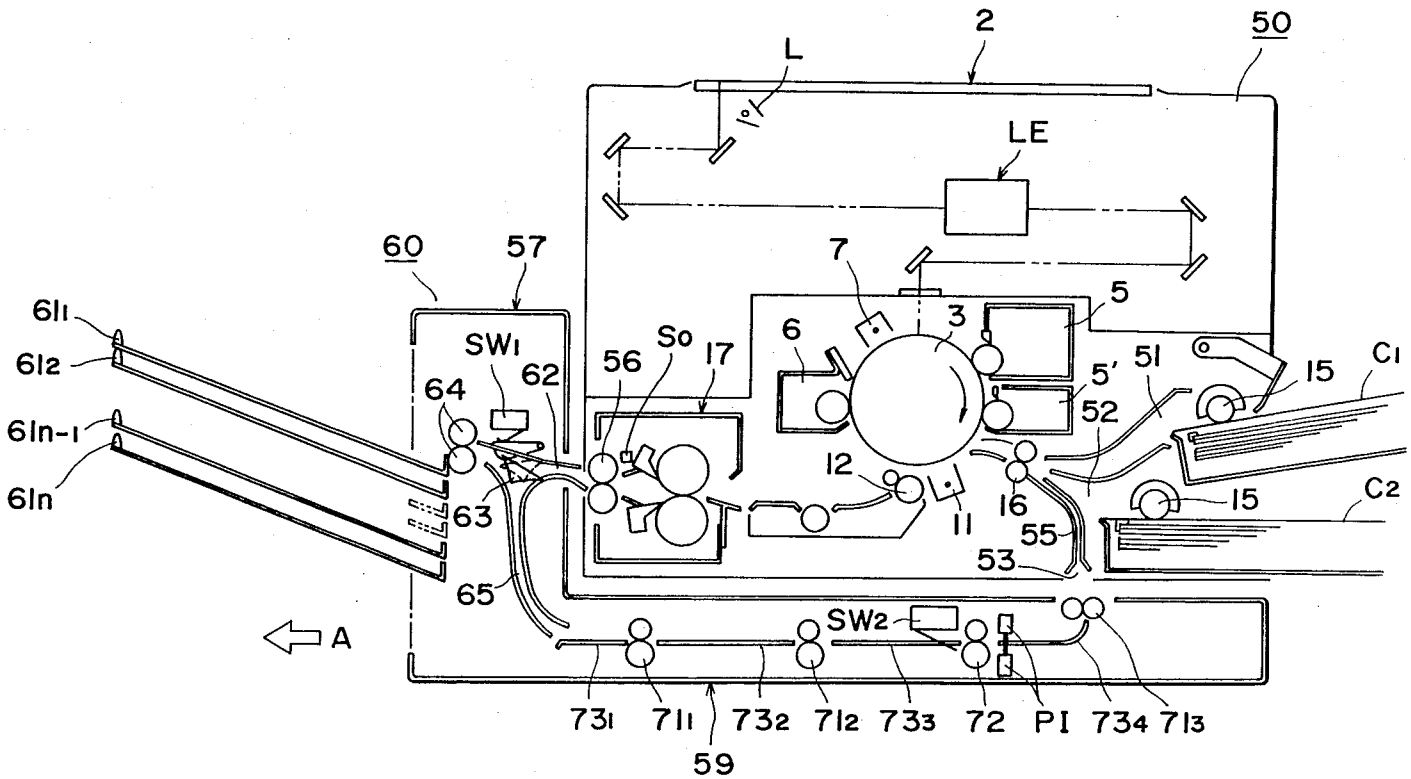
FIG. 18 is a sectional view of an apparatus accordng to a fifth embodiment of the present invention.

FIG. 18 shows the fifth embodiment of the present invention. Since this embodiment is similar to the first embodiment in some aspects, the detailed explanation is omitted for the sake of simplicity by assigning the same reference numerals to the corresponding elements.

In this embodiment, the sheet stacking device 60 has a sorter portion 57 which includes vertically movable sheet accommodating trays $61_1$–$61_n$ which are further movable vertically respectively.

Firstly, the description will be made as to a sorting operation mode wherein copies are made on a number (n) of sheets, which are then sorted in a predetermined order. The sheet on one side of which an image is formed, is conveyed to the discharging rollers 56 and is discharged thereby to the passage 62 of the stacking device 62. At this time, the first flapper 63 occupies the solid line position as shown in FIG. 3, and the movable trays $61_1$–$61_{n-1}$ takes the lowermost position wherein the first tray $61_1$ is faced to the discharging rollers 64. This is the initial setting. The first sheet from the passage 62 is discharged to the first tray $61_1$ and stacked there. When n copies of originals (Page a–Page z) are to be taken and sorted, the first copy sheet of Page a is received by the first tray $61_1$, and immediately thereafter, the trays are shifted up so that the second tray $61_2$ is aligned with the discharging roller couple 64. Then, the second copy sheet of the same page of the original is received by the second tray $61_2$. The same operations are repeated until the (n)th sheet is received on the (n)th tray $61_n$. Similarly, n copies of Page b are stacked on the trays $61_1$–$61_n$, and further the operations are repeated until the copies of Page z are stacked.

Next, the duplex copy will be described. When the operator instructs the duplex mode and actuates the copy button, the first discharging roller 64 is rotated forwardly, and the first flapper 63 is set in the solid line position. Further, the trays $61_1$–$61_n$ are all set at the lowermost position. When the copied sheet is discharged by the discharging roller couple 56 to the passage 62 of the sheet stacking device 60, the sheet is guided by the first flapper 63 to the first discharging roller couple 64, which rotates forwardly to advance the sheet to the tray $61_1$. When it travels to the passage 62, the leading edge thereof raise the auxiliary guide member 81. By the guide member 81, the detection switch $SW_1$ is actuated to sense the passage of the sheet. When the trailing edge passes the auxiliary guide member 81, the member 81 resets by its own weight, so that the detection switch $SW_1$ is rendered off at the position where the discharging roller couple 64 grips the trailing edge portion of the sheet. Then, the reversible motor 82 is reversed and the sheet is fed from the tray side to the flapper 63. At this time the leading edge (the trailing edge before the sheet is fed back) is abutted to and guided by the perpendicular portion 81*a* of the guide member 81 to the passage 65. The time period (T) during which the switch $SW_1$ is on is measured by a clock-pulse counter whereby the length of the sheet is determined. The count (T) plus a margin (a) is subtracted from the same counter from the start of reversal rotation of the first discharging roller couple 64. When the subtraction ends, the sheet is deemed to have departed from the discharging roller couple 64. After this, the DC motor 82 is rotated forwardly to prepare for the next sheet.

The sheet transported to the passage 65 is fed by the roller couples $71_1$ and $71_2$ and arrives at the detection switch $SW_2$ to actuate it. The inclination and lateral deviation of the sheet is adjusted in the same manner as described with respect to the first embodiment. After elapse of a predetermined period of time from the restart of the adjusting roller couple 72, the driving power to the sheet feeder 59 is stopped, and the apparatus waits for the sheet feeding signal. After the operator replaces the original 2, the starting switch is actuated. Then, the other side of the sheet is copied in the main assembly 50.

In the superimposed copy mode, the first flapper 63 is switched to the chain line position so as to feed the sheet to the passage 65. Similarly to the described above with respect to the first embodiment, the superimposed copies are discharged to the trays. The operations are repeated with moving the bin trays upwardly step-by-step, the same superimposed copies are produced.

Sixth Embodiment

Figure 19:
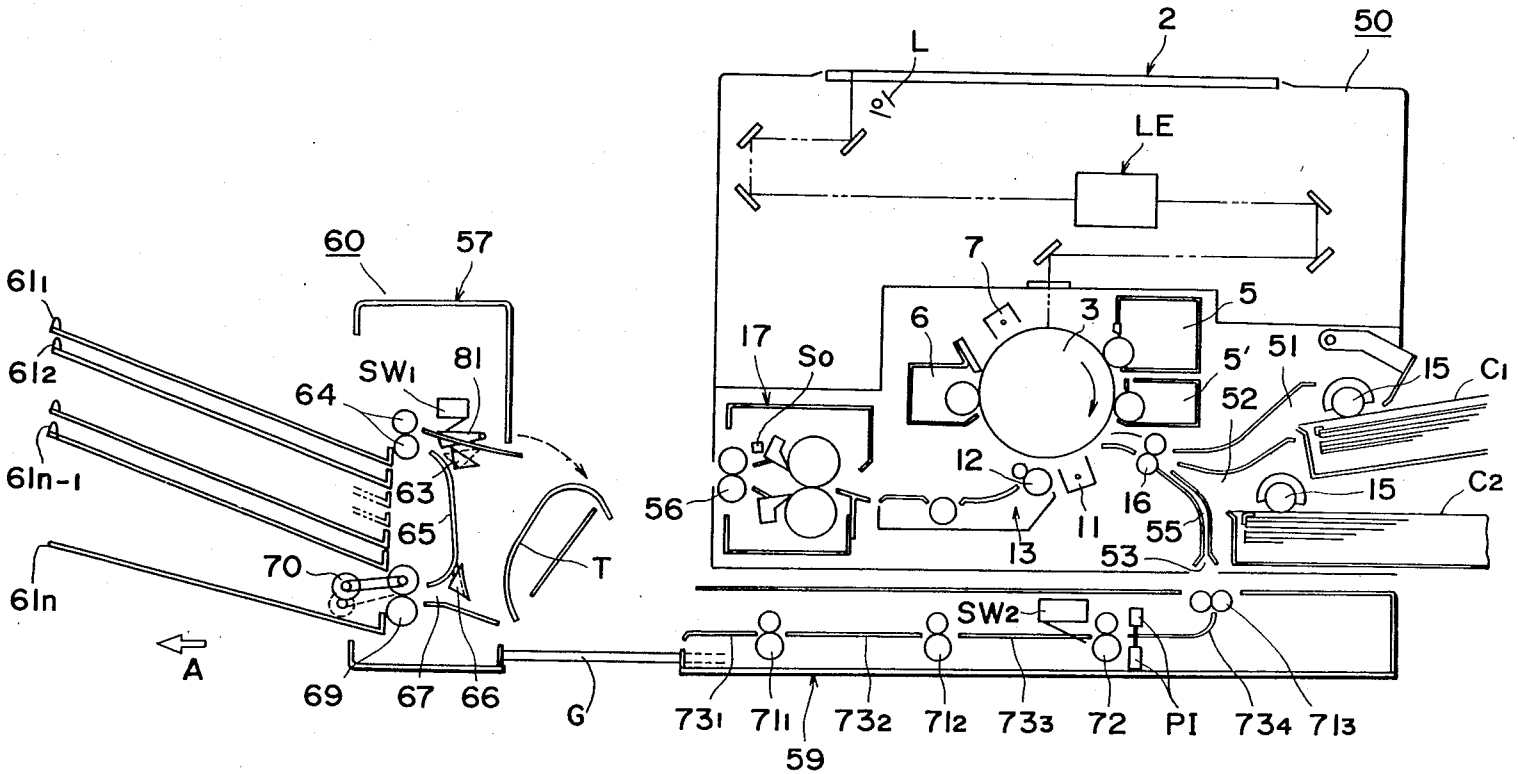
FIG. 19 is a sectional view of an apparatus according to a sixth embodiment of the present invention showing a separated sheet stacking device and copying machine.

FIG. 19 illustrates the sixth embodiment of the present invention. Since this embodiment is similar to the first embodiment in some aspects, the detailed description will be omitted for the sake of simplicity by assigning the same reference numerals to the corresponding elements.

In this embodiment, the side plates constituting the lower frame of the sheet feeder 59 are provided with guide rails G. The guide rails G are effective to guide the sheet stacking device 60 when it is inserted or retracted in the direction which is the same as or the opposite to the arrow A. Also, it is effective to align the roller couple $71_3$ with the inlet 53 of the main apparatus, further to align the discharging roller couple 55 with the passage 62. When the sheet stacking device 60 has been moved in the direction of the arrow A, the guide plate T constituting the passages 62 and 65 can be separated.

Therefore, when the paper jam or the like occurs in the sheet stacking device 60, the sheet stacking device 60 is retracted in the direction of the arrow A as shown in FIG. 19, thus separating the stacking device 60 from the copying machine 50. Then, the guide plate T is removed so as to open the passages 62 and 65. It is easy to access to the passages so that the paper jam can be easily disposed of.

Seventh Embodiment

Figure 20:
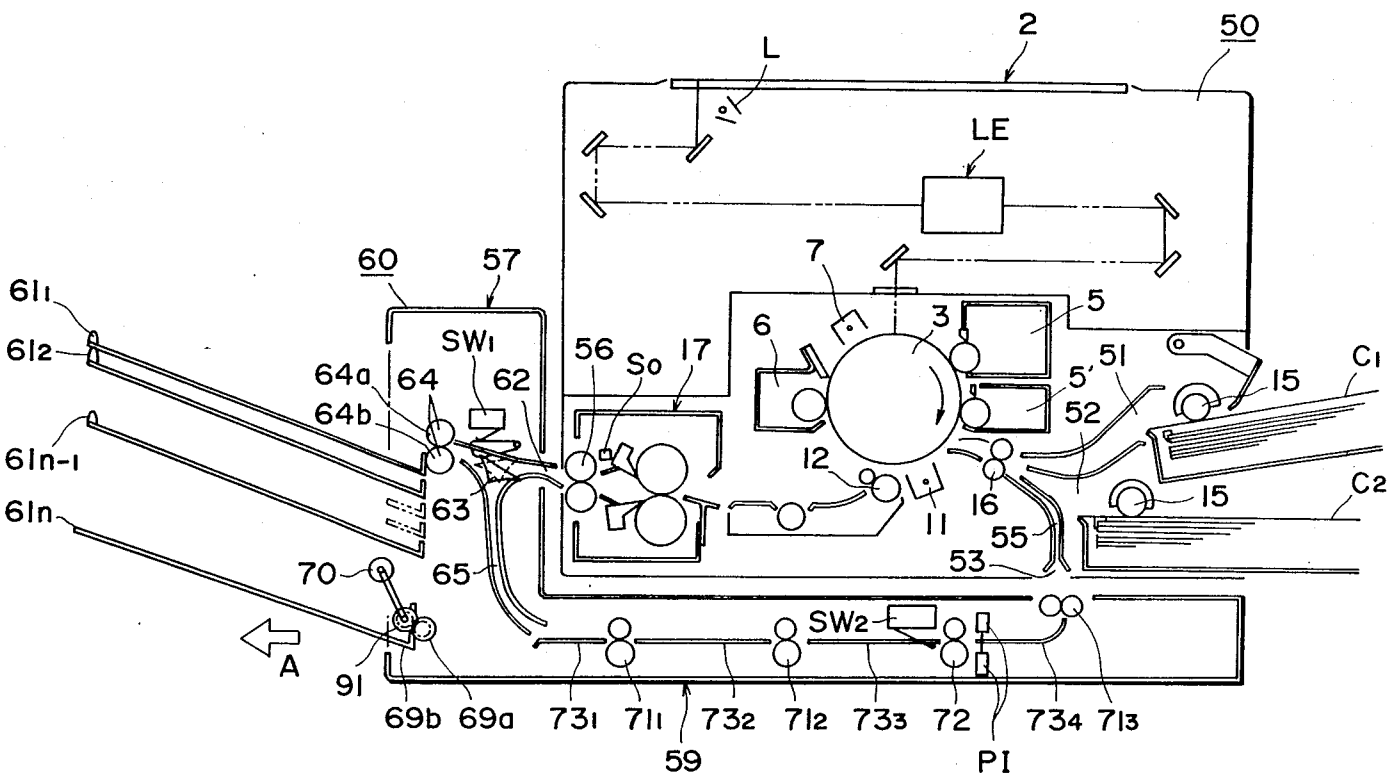
FIG. 20 is a sectional view of an apparatus according to a seventh embodiment of the present invention.
Figure 21:
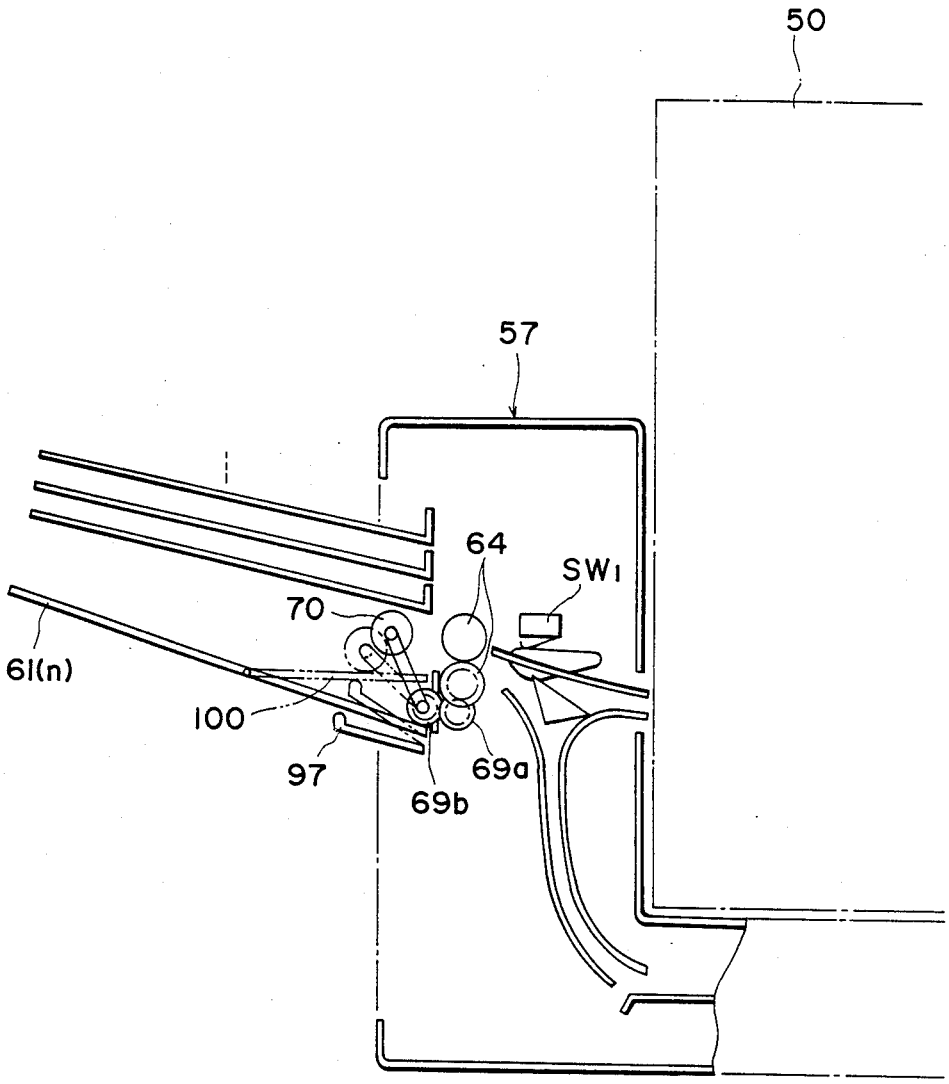
FIG. 21 is a side view of a sorter illustrating the sheet re-feeding operaton.
Figure 22:
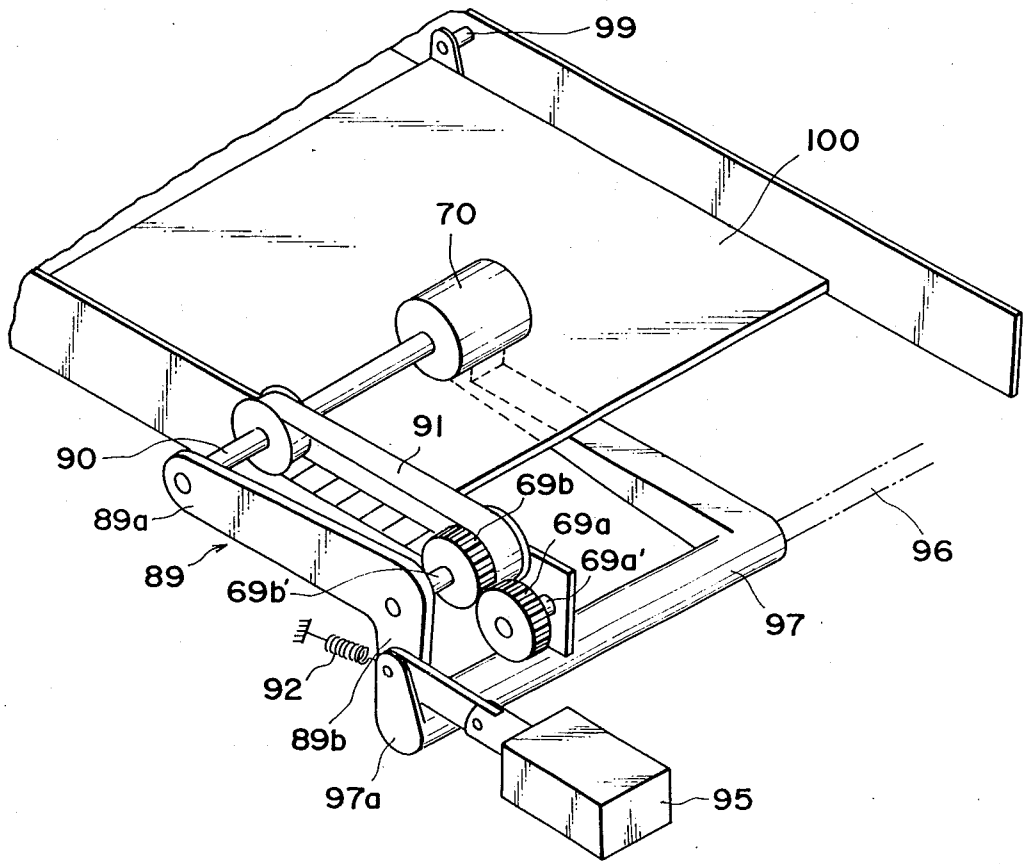
FIG. 22 is a perspective view illustrating the structure around the sheet re-feeding mechanism.

The seventh embodiment will be described, referring to FIGS. 20, 21 and 22.

Figure 1:
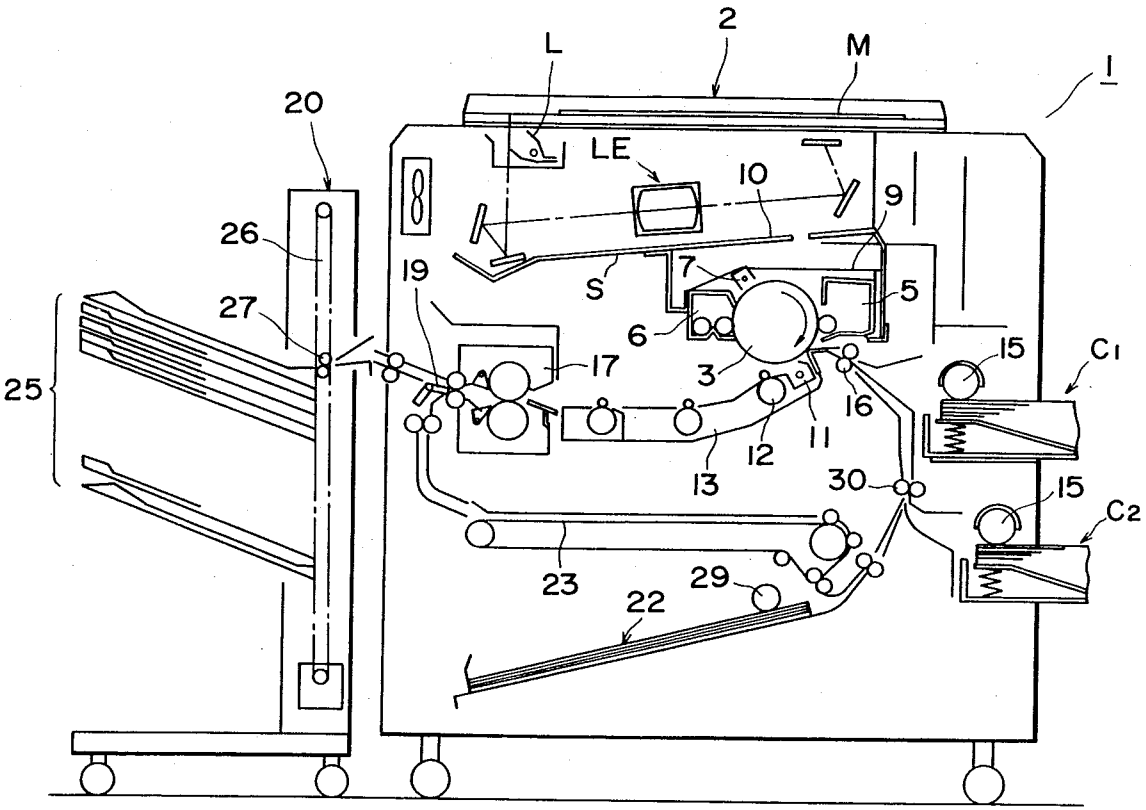
FIG. 1 PRIOR ART
FIG. 1 is a sectional view of a conventional copying machine.
Figure 2:
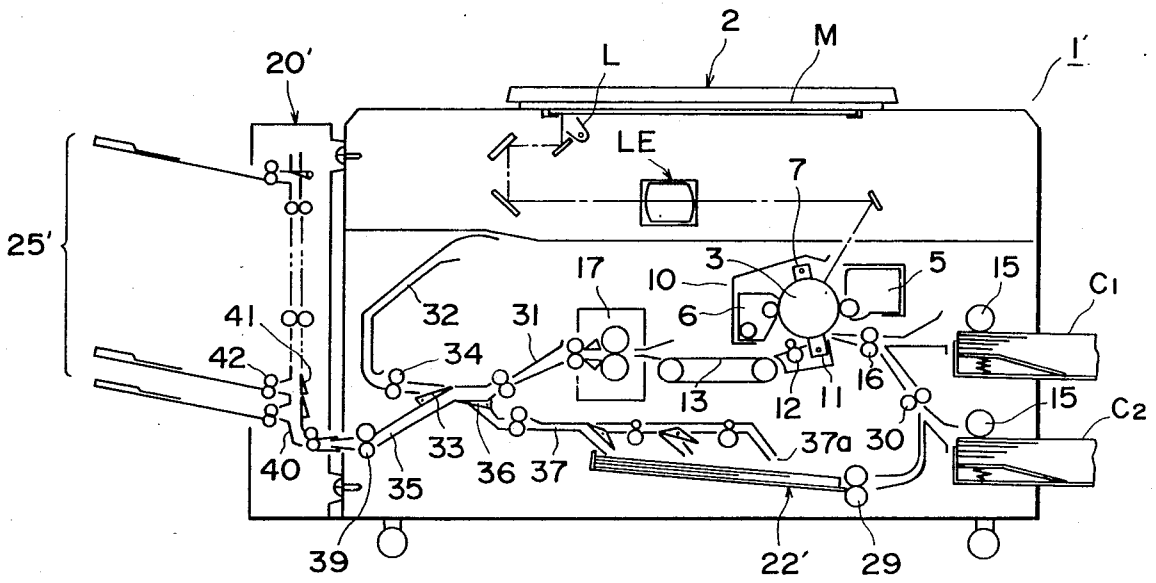
FIG. 2 PRIOR ART
FIG. 2 is a sectional view of another conventional copying machine.

A sheet stacking device including a sheet sorter 57 and a sheet feeder 59 is disposed adjacent the main assembly 50 of the copying apparatus. The sorter 57 is provided with a number (n) of vertically movable bin trays $61_1$, $61_2$ - - - $61_n$ for accommdating the sheets. The bottommost bin tray $61_n$ is provided with a gear **69*a* and a gear 69*b* which are meshed with each other. As shown in FIG. 2, when the tray $61_n$ is brought into alignment with the discharging roller couple 64, the rotation of the lower roller 64*b* of the discharging roller couple 64 is transmitted to the ggear 69*a* through an unshown gear. Above the tray $61_n$, a re-feeding roller 70 is provided on the arm which is pivotable. The roller 70 is interrelated with the gear 69*b* through a timing belt 91. The sorter 57 has a passage 62 alignable with the discharging rollers 56 of the main assembly and has a flapper 63 which will be described in detail hereinafter, and a couple of discharging rollers 64 which are effective to discharge the sheets to the movable trays $61_1$–$61_n$ As shown in FIG. 22, the gears 69*a* and 69*b* are fixed to respective shafts 69*a*' and 69*b*' and are rotatably supported on the frame of the bottommost tray $61_n$ by the shafts. A bell crank 89 provided with arms 89*a* and 89*b* is rotatably mounted to the gear shaft 69*b*'. In the neighborhood of an end of the arm 89*a*, the re-feeding roller 70 is rotatably supported by a shaft 90. The shaft 90 is interrelated with the gear shaft 69*b*' through a timing belt 91 so that the re-feeding roller 70 is rotated in synchronism with and in the same direction as the gear 69*b*. An end portion of the other arm 89*b* of the bell crank 89 is connected to a spring 92 which is stretched. A solenoid 95 is connected to the end portion of the arm 89*b* by a link 93 to pull against the force of the spring 92. A shaft 96 extending between the side plates of the bin tray $61_n$ rotatably supports a backup link 97. An end of the link 97 is formed into an arm 97*a* which is operatively connected to the solenoid link 93 together with the arm 89*b* through a long slot or the like. The backup link 97 extends below the re-feeding roller 70 to contact an auxiliary plate 100 pivotably supported on the base of the tray $61_n$ by a pin 99. Therefore, in synchronism with the re-feeding roller 70, that is, together with the lowering action of the re-feeding roller 70, the back-up link 97 pivots the auxiliary plate 100 upwardly to assist the re-feeding of the sheet from the auxiliary plate 100**.

Next, the operation of the apparatus according to this embodiment will be described.

Firstly, the description will be made as to a sorting operation mode wherein copies are made on a number (n) of sheets, which are then sorted in a predetermined order.

The sheet on one side of which an image formed, is conveyed to the discharging rollers 56 and is discharged thereby to the passage 62 of the stacking device. At this time, the first flapper 63 occupies the solid line position as shown in FIG. 3, and the movable trays $61_1$–$61_{n-1}$ take the lowermost position wherein the first tray $61_1$ is faced to the discharging rolrs 64. This is the initial setting. The first sheet from the passage 62 is discharged to the first tray $61_1$ and stacked there. When n copies of originals (Page a–Page z) are to be taken and sorted, the first copy sheet of Page a is received by the first tray 61, and immediately thereafter, the trays are shifted up so that the second tray $61_2$ is aligned with the discharging roller couple 64. Then, the second copy sheet of the same page of the original is received by the second tray $61_2$. The same operations are repeated until the (n)th sheet is received on the (n)th tray $61_n$. At this time, the re-feeding roller 70 takes its upper position indicated by solid lines in FIG. 3 so as not to interfere with the discharging sheet to the tray $61_n$ provided with the re-feeding roller 70. In the same manner, n copy sheets are stacked on the trays $61_1$–$61_n$. By repetition, n sets of copies from Page a through Page z are stacked on the trays.

Next, the duplex copy mode will be described. When the operator inputs "n" as a number of duplex copies and actuates the copy button, the sorter 57 is set for the duplex copy mode, wherein the bottommost tray $61_n$ is aligned with the discharging roller couple 64 with the result that the bin trays are at the upper position. The gear 69a mounted to the tray $61_n$ is meshed with an unshown gear of the lower roller 64b of the discharging roller couple 64, and the flapper 63 is stated in the position shown by the solid lines in FIG. 20. When the sheet on one side of which an image is formed (which will hereinafter be called "simplex copy sheet"), is conveyed to the discharging rollers 56 and to the passage 62, the sheet is guided by the flapper 63 and is discharged to the tray $61_n$ by the discharging roller couples 64. At this time, by operation of unshown spring clutch, the roller couple 69 rotates for forward transportation, that is, they are cooperative to move the sheet to the tray $61_n$. The solenoid 95 is not energized, and therefore, the re-feeding roller 70 takes its upper position. These operations are repeated n times, and n simplex copy sheets are stacked on the tray $65_n$. When the (n)th simplex copy sheet passes, the trailing edge thereof is detected by a sensor $S_0$ of the main assembly. With a time delay property set for the last sheet to arrive at and be stacked on the tray $61_n$, the apparatus automatically stops the simplex copy operation to prepare for the other side copy operation. The rotation of the discharging rollers 64 of the stacking device 60 also stops. A duplex copy signal for starting image formation on the other sides is generated. The solenoid 95 is energized to rotate the bell crank 89 in the counterclockwise direction, so as to lower the re-feeding roller 70 to rotate the backup link 97 to the clockwise direction to raise the auxiliary plate 100. The lower roller shaft 64b' is rotated forwardly, and by an action of an unshown spring clutch, the upper roller shaft 64a' is rotated backwardly. By doing so, the lower roller 64b rotates forwardly, while the upper roller 64a rotates backwardly, that is, the direction for feeding the sheet from the tray $61_n$ to the passage 62. The rotation of the lower roller shaft 64b' is transmitted through a gear to the gear 69a of the tray $61_n$. The rotation of the gear 69a is transmitted through the gear 69b and the timing belt 91 to the re-feeding roller 70 which then rotates in the direction of feeding the sheet from the tray $61_n$ to the passage 62. Therefore, the simplex sheets stacked on the tray $61_n$, more particularly, the auxiliary plate 100 thereof, are fed by the re-feeding roller 70 to the discharging roller couple 64, further to the passage 65. The sheet is conveyed further to the feeding roller 71 of the sheet feeder 59. If there is a tendency for double feed, the forward rotation of the lower roller 64b is effective to separate out the topmost sheet contacting the upper roller 64a and feed the sheet only. After the sufficient time has passed for the sheet to be gripped by the roller couple $71_1$, the solenoid 95 is deenergized to allow the re-feeding roller 70 to rise, and a forward rotation force is applied by an action of unshown spring clutch to the upper roller 64a, whereby the re-feeding of sheet is deferred.

After the inclination and the lateral deviation are corrected and after a predetermined period of time has passed from the reactuation of the adjusting roller couple 72 as in the first embodiment, the driving force to the sheet feeder 59 is stopped to stop the sheet feeding, and the feeder waits for the feeding signal from the main assembly 50. After the operator does necessary work such as replacing the original, the actuation switch of the apparatus 50 is rendered on, so that the sheet feeder 59 is driven by the driving motor in timed relation with the main assembly 50. By this, the adjusting roller couple 72 and the feeding roller couple $71_3$ rotate again so as to feed the sheet into the passage 55 through the inlet 53. A toner image is transferred by the charger 11 from the photosensitive member 3 to a fresh side of the simplex copy sheet. The toner image is then fixed by the fixing device 70. The duplex copy sheet now bearing the image on both sides thereof is discharged by the discharging roller couple 56 to the stacking device 60. At this time, when the duplex copy sheet passes by the sheet sensor $S_0$, and the trailing edge is detected, the trays $61_1$–$61_n$ are lowered, and the discharging roller couple 64 of the sheet stacking device 60 is rotated in the forward direction, that is, the direction for discharging the sheet to the bin tray, so that the sheet is discharged to the topmost bin tray $61_1$, for example. The sorter 57 sorts the duplex copy sheet in the preset order on the trays $61_1$–$61_n$.

In this embodiment, the re-feeding roller 70 is mounted to the bottommost tray $61_n$, but this is not limiting. For example, it may be mounted to the topmost bin tray $61_1$. The embodiment has been described as being a copying machine, but it may be a laser beam printer. In the case of copying machine, the original may be a book or a sheet of document. In the case of book originals, the images of the opened pages can be copied on the respective sides of a copy sheet. In the first copying operation, one of the pages is scanned and copied on a copy sheet. Thereafter, the adjacent page is scanned and copied on the backside of the same copy sheet.

The present invention is usable with a machine wherein a sheet original is recirculated to take plural copies, or the machine wherein a plurality of copies is taken while the sheet original is at rest. Also, it is usable with a machine wherein a plurality of duplex sheet originals are stacked on an original tray; one of the originals is fed; an image is formed on one side of a sheet; the original is inverted to change the face orientation; the other side of the original is copied; and the original is returned to the original tray.

While the invention has been described with reference to the structures disclosed herein, it is not confined to the details set forth and this application is intended to cover such modifications or changes as may come within the scope of the following claims.

What is claimed is:

1. A sheet stacking device usable with an image forming apparatus capable of forming a superimposed image on a side of a sheet, comprising:

a sheet sorter portion, having a plurality of movable sheet accommodating bin trays and a fixed re-feeding tray, each tray for receiving a sheet adjacent one end thereof from the image forming apparatus, for sorting and stacking sheets received thereby;

a reversibly rotatable feeding member for leading the sheets to the movable bin trays from the image forming apparatus;

sheet re-feeding means for re-feeding the sheet which has entered said fixed refeeding tray by reverse feeding the sheet from said one end of said fixed refeeding tray; and a conveyor portion for conveying back into the image forming apparatus the sheet re-fed from the fixed re-feeding tray, whereby plural sheets can be re-fed.

2. A device according to claim 1, wherein said fixed re-feeding tray associated with said sheet re-feeding means is stationary, while the other bin trays are substantially vertically movable to be aligned with said rotatable feeding member.

3. A sheet stacking device usable with an image forming apparatus capable of forming images on both sides of a sheet, comprising:

a sheet sorter portion, having a plurality of sheet accommodating bin trays, each tray for receiving a sheet adjacent one end thereof by feed means from the image forming apparatus, for sorting and stacking sheets received thereby;

sheet re-feeding means for re-feeding the sheet which has entered one of said bin trays, by reverse feeding the sheet from said one end of said bin tray;

a conveyor portion for conveying back into the image forming apparatus the sheet re-fed from said bin tray;

a re-feeding tray for receiving the sheet adjacent one end thereof from said sheet re-feeding means; and additional sheet refeeding means for re-feeding the sheet which has entered said re-feeding tray by reverse feeding the sheet from the one side of said re-feeding tray, to said conveyor portion.

4. A device according to claim 3, wherein said re-feeding tray is stationary.

5. A device according to claim 3, wherein said refeeding tray is another one of said bin trays.

6. A device according to claim 3, further comprising a passage for directing the sheet discharged from an image forming station of the image forming apparatus to said conveyor portion.

7. A device according to claim 3, wherein said additional re-feeding means is capable of re-feeding one by one the sheets stacked on said re-feeding tray.

8. A sheet stacking device, comprising:

a sheet sorter portion, having a plurality of sheet accommodating bin trays, each tray for receiving a sheet adjacent one end thereof by feed means for sorting and stacking sheets received thereby;

sheet re-feeding means for re-feeding the sheet which has entered one of said bin trays by reverse feeding the sheet from said one side of said bin tray:

a conveyor portion for conveying back the sheet re-fed from said one bin tray, wherein said sheet sorter portion, sheet re-feeding means and said conveyor portion are constructed as a unit mountable to and detachable from an image forming apparatus, and wherein said conveyor portion extends substantially horizontally, said sheet sorter portion extends substantially vertically, and said conveyor and sheet sorter portions are mutually arranged substantially in an L-shape.

9. A device according to claim 8, further comprising a refeeding tray for receiving a sheet adjacent one end thereof from said sheet re-feeding means, and additional sheet refeeding means for re-feeding the sheet which has entered said re-feeding tray by reverse feeding the sheet from the one side of said re-feeding tray, to said conveyor portion.

10. A device according to claim 9, wherein said re-feeding tray is stationary.

11. A device according to claim 9, wherein said re-feeding tray is another one of said bin trays.

12. A device according to claim 9, further comprising a passage for directing the sheet discharged from an image forming station of the image forming apparatus to said conveyor portion.

13. A device according to claim 9, wherein said additional re-feeding means is capable of re-feeding one by one the sheets stacked on said refeeding tray.

14. A device according to claim 9, further comprising guiding means for guiding said sorter portion.

* * * * *

UNITED STATES PATENT AND TRADEMARK OFFICE

CERTIFICATE OF CORRECTION

PATENT NO. : 4,787,616

DATED : November 29, 1989

INVENTOR(S) : NOBUKAZU SASAKI, ET AL.

It is certified that error appears in the above-identified patent and that said Letters Patent is hereby corrected as shown below:

[56], "pp. 1379-1387" should read --pp. 1379-1381--.

Column 2, line 54, "whcih" should read --which--.

Column 3, line 19, "duple" should read --duplex--;

line 37, "located" should read --locate--;

line 64, "availble" should read --available--.

Column 4, line 13, "availble," should read --available,--.

Column 5, line 13, "at relatively" should read --at a relatively--;

line 20, "multi-fun-" should read --multi-func--;

line 22, "advanges" should read --advantages--;

line 45, "small sized" should read --small-size--.

Column 6, line 4, close up right margin;

line 5, close up right margin;

line 12, "occurs" should read --occur--;

line 14, "This," should read --This--;

line 33, "et" should read --a sheet--;

line 62, "accordng" should read --according--.

UNITED STATES PATENT AND TRADEMARK OFFICE

CERTIFICATE OF CORRECTION

PATENT NO. : 4,787,616

DATED : November 29, 1989

INVENTOR(S) : NOBUKAZU SASAKI, ET AL.

It is certified that error appears in the above-identified patent and that said Letters Patent is hereby corrected as shown below:

Column 7, line 2, "operaton." should read --operation.--;

line 20, "which a" should read --which are a--;

line 39, "$61_1$, $61_2$-$61_{n-1}$" should read --$61_1$, $61_2$, ... $61_{n-1}$--;

line 54, "passage 68" should read --passage 68.--.

Column 8, line 21, "65" should read --62--;

line 50, "include" should read --includes--;

line 62, "grain" should read --train--.

Column 9, line 12, "whole" should read --hole--;

line 42, "adusting roller couple 72" should read --pair of adjusting rollers 72--;

line 43, "$S_2$" should read --$SW_2$--;

line 49, "portions" should read --portion line 51, "pair $71_1$, $71_2$" should read --pairs $71_1$, $71_2$--.

UNITED STATES PATENT AND TRADEMARK OFFICE

CERTIFICATE OF CORRECTION

PATENT NO. : 4,787,616

DATED : November 29, 1989

INVENTOR(S) : NOBUKAZU SASAKI, ET AL.

It is certified that error appears in the above-identified patent and that said Letters Patent is hereby corrected as shown below:

Column 10, lines 12-13, "first flapper 63" should read --passage 62--;

line 14, "$61_n$" should read --tray $61_n$--;

line 32, "hereinafter,is" should read --hereinafter, is--.

Column 11, line 14, "grain" should read --train--;

line 44, "photoinerrupter" should read --photointer-rupter--.

Column 12, line 18, "grips" should read --grip--;

line 30, "ends," should read --ends--;

line 41, "$65_n$" should read --$61_n$--;

line 44, "$65_n$" should read --$61_n$--;

line 59, "rolels couple 56," should read --rollers 56,--.

Column 13, line 4, ",main" should read --main--;

line 17, "to" should be deleted;

line 26, "17" should read --127--;

UNITED STATES PATENT AND TRADEMARK OFFICE

CERTIFICATE OF CORRECTION

PATENT NO. : 4,787,616

DATED : November 29, 1989

INVENTOR(S) : NOBUKAZU SASAKI, ET AL.

It is certified that error appears in the above-identified patent and that said Letters Patent is hereby corrected as shown below:

Column 13, line 39, "roller (135, $135_n$)" should read --rollers (135, $135_n$)--;

line 59, "plate" should read --plates--.

Column 14, line 67, "roller couple" should read --roller pair--.

Column 15.

line 44, "through," should read --through--.

Column 16, line 13, "whre" should read --where--;

line 28, "grain" should read --train--.

Column 17, line 16, "tray 611" should read --tray $61_1$--;

line 20, "$135_1$" should read --$126_2$--;

line 41, "$142_1$ - $145_4$" should read --$142_1$ - $142_4$--;

line 67, "superposed" should read --superimposed--.

Column 18, line 11, "tray" should read --tray passage--;

line 47, "counterclockwisely" should read --counterclockwise--.

UNITED STATES PATENT AND TRADEMARK OFFICE

CERTIFICATE OF CORRECTION

PATENT NO. : 4,787,616

DATED : November 29, 1989

INVENTOR(S) : NOBUKAZU SASAKI, ET AL.

It is certified that error appears in the above-identified patent and that said Letters Patent is hereby corrected as shown below:

Column 19, line 1, "611" should read --$61_1$--;

line 2, "tray" should read --tray passage--;

line 30, "positions" should read --portions--.

Column 20, line 23, "62." should read --60.--;

line 25, "takes" should read --take--;

line 51, "raise" should read --raises--;

Column 21, line 39, "roller couple 55" should read --passage 55--;

line 60, "accommdating" should read --accommodating--;

line 66, "ggear" should read --gear--.

Column 22, line 45, "rolrs" should read --rollers--;

line 49, "61" should read --$61_1$--.

UNITED STATES PATENT AND TRADEMARK OFFICE

CERTIFICATE OF CORRECTION

PATENT NO. : 4,787,616

DATED : November 29, 1989

INVENTOR(S) : NOBUKAZU SASAKI, ET AL.

It is certified that error appears in the above-identified patent and that said Letters Patent is hereby corrected as shown below:

Column 23, line 3, "stated" should read --seated--;

line 19, "property" should read --properly--.

Column 24 line 3, "70" should read --17--.

line 62, "fixed" should read --said fixed--.

Signed and Sealed this

Sixth Day of June, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,787,616

DATED : November 29, 1988

INVENTOR(S) : NOBUKAZU SASAKI, ET AL.

It is certified that error appears in the above-identified patent and that said Letters Patent is hereby corrected as shown below: On the title page:

[56], "pp. 1379-1387" should read --pp. 1379-1381--.

Column 2, line 54, "whcih" should read --which--.

Column 3, line 19, "duple" should read --duplex--;

line 37, "located" should read --locate--;

line 64, "availble" should read --available--.

Column 4, line 13, "availble," should read --available,--.

Column 5, line 13, "at relatively" should read --at a relatively--;

line 20, "multi-fun-" should read --multi-func--;

line 22, "advanges" should read --advantages--;

line 45, "small sized" should read --small-size--.

Column 6, line 4, close up right margin;

line 5, close up right margin;

line 12, "occurs" should read --occur--;

line 14, "This," should read --This--;

line 33, "et" should read --a sheet--;

line 62, "according" should read --according--.

UNITED STATES PATENT AND TRADEMARK OFFICE

CERTIFICATE OF CORRECTION

PATENT NO. : 4,787,616

DATED : November 29, 1988

INVENTOR(S) : NOBUKAZU SASAKI, ET AL.

It is certified that error appears in the above-identified patent and that said Letters Patent is hereby corrected as shown below:

Column 7, line 2, "operaton." should read --operation.--;

line 20, "which a" should read --which are a--;

line 39, "$61_1$, $61_2$-$61_{n-1}$" should read --$61_1$, $61_2$, ... $61_{n-1}$--;

line 54, "passage 68" should read --passage 68.--.

Column 8, line 21, "65" should read --62--;

line 50, "include" should read --includes--;

line 62, "grain" should read --train--.

Column 9, line 12, "whole" should read --hole--;

line 42, "adusting roller couple 72" should read --pair of adjusting rollers 72--;

line 43, "$S_2$" should read --$SW_2$--;

line 49, "portions" should read --portion line 51, "pair $71_1$, $71_2$" should read --pairs $71_1$, $71_2$--.

UNITED STATES PATENT AND TRADEMARK OFFICE

CERTIFICATE OF CORRECTION

PATENT NO. : 4,787,616

DATED : November 29, 1988

INVENTOR(S) : NOBUKAZU SASAKI, ET AL.

It is certified that error appears in the above-identified patent and that said Letters Patent is hereby corrected as shown below:

Column 10, lines 12-13, "first flapper 63" should read --passage 62--;

line 14, "$61_n$" should read --tray $61_n$--;

line 32, "hereinafter,is" should read --hereinafter, is--.

Column 11, line 14, "grain" should read --train--;

line 44, "photoinerrupter" should read --photointer-rupter--.

Column 12, line 18, "grips" should read --grip--;

line 30, "ends," should read --ends--;

line 41, "$63_n$" should read --$61_n$--;

line 44, "$65_n$" should read --$61_n$--;

line 58, "rolels couple 56," should read --rollers 56,--.

Column 13, line 4, ",main" should read --main--;

line 17, "to" should be deleted;

line 26, "17" should read --127--;

UNITED STATES PATENT AND TRADEMARK OFFICE

CERTIFICATE OF CORRECTION

PATENT NO. : 4,787,616

DATED : November 29, 1988

INVENTOR(S) : NOBUKAZU SASAKI, ET AL.

It is certified that error appears in the above-identified patent and that said Letters Patent is hereby corrected as shown below:

Column 13, line 39, "roller (135, $135_n$)" should read --rollers (135, $135_n$)--;

line 59, "plate" should read --plates--.

Column 14, line 67, "roller couple" should read --roller pair--.

Column 15, line 44, "through," should read --through--.

Column 16, line 13, "whre" should read --where--;

line 28, "grain" should read --train--.

Column 17, line 16, "tray 611" should read --tray $61_1$--;

line 20, "$135_1$" should read --$126_2$--;

line 41, "$142_1$ - $145_4$" should read --$142_1$ - $142_4$--;

line 67, "superposed" should read --superimposed--.

Column 18, line 11, "tray" should read --tray passage--;

line 47, "counterclockwisely" should read --counterclockwise--.

UNITED STATES PATENT AND TRADEMARK OFFICE

CERTIFICATE OF CORRECTION

PATENT NO. : 4,787,616

DATED : November 29, 1988

INVENTOR(S) : NOBUKAZU SASAKI, ET AL.

It is certified that error appears in the above-identified patent and that said Letters Patent is hereby corrected as shown below:

Column 19, line 1, "611" should read --$61_1$--;

line 2, "tray" should read --tray passage--;

line 30, "positions" should read --portions--.

Column 20, line 23, "62." should read --60.--;

line 25, "takes" should read --take--;

line 51, "raise" should read --raises--;

Column 21, line 39, "roller couple 55" should read --passage 55--;

line 60, "accommdating" should read --accommodating--;

line 66, "ggear" should read --gear--.

Column 22, line 45, "rolrs" should read --rollers--;

line 49, "61" should read --$61_1$--.

UNITED STATES PATENT AND TRADEMARK OFFICE

CERTIFICATE OF CORRECTION

PATENT NO. : 4,787,616 Page 6 of 6

DATED : November 29, 1988

INVENTOR(S) : NOBUKAZU SASAKI, ET AL.

It is certified that error appears in the above-identified patent and that said Letters Patent is hereby corrected as shown below:

Column 23, line 3, "stated" should read --seated--;

line 19, "property" should read --properly--.

Column 24 line 3, "70" should read --17--.

line 62, "fixed" should read --said fixed--.

This certificate supersedes Certificate of Correction issued June 6, 1989.

Signed and Sealed this

Seventh Day of May, 1991

*Attest:*

*Attesting Officer*

HARRY F. MANBECK, JR.

*Commissioner of Patents and Trademarks*